US010254709B2

(12) United States Patent
Mizutani

(10) Patent No.: US 10,254,709 B2
(45) Date of Patent: Apr. 9, 2019

(54) DEVELOPING CARTRIDGE INCLUDING HOLDER THAT HOLDS ELECTRICAL CONTACT SURFACE

(71) Applicant: BROTHER KOGYO KABUSHIKI KAISHA, Nagoya-shi, Aichi-ken (JP)

(72) Inventor: Hiromitsu Mizutani, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,787

(22) Filed: Sep. 29, 2017

(65) Prior Publication Data

US 2018/0284690 A1 Oct. 4, 2018

(30) Foreign Application Priority Data

Mar. 30, 2017 (JP) ..... 2017-067272

(51) Int. Cl.
*G03G 15/08* (2006.01)
*G03G 21/16* (2006.01)

(52) U.S. Cl.
CPC ..... *G03G 21/1652* (2013.01); *G03G 15/0863* (2013.01); *G03G 15/0865* (2013.01)

(58) Field of Classification Search
None
See application file for complete search history.

(56) References Cited

U.S. PATENT DOCUMENTS

2008/0199204 A1 8/2008 Ishii et al.
2011/0064457 A1 3/2011 Okabe et al.
2011/0129252 A1* 6/2011 Oda ..... G03G 21/1821 399/119

(Continued)

FOREIGN PATENT DOCUMENTS

EP 3 118 689 A1 1/2017
JP 2008-242085 A 10/2008

(Continued)

OTHER PUBLICATIONS

International Search Report and Written Opinion issued in related International Application No. PCT/JP2017/035401, dated Nov. 28, 2017.

(Continued)

*Primary Examiner* — Victor Verbitsky
(74) *Attorney, Agent, or Firm* — Merchant & Gould P.C.

(57) ABSTRACT

A developing cartridge includes a housing, a developing roller positioned at one end of the housing in a second direction, a storage medium having an electric contact surface, a resilient member and a first holder positioned at one end of the housing in a first direction, and a second holder holding the electric contact surface. The resilient member can expand and contract in a third direction crossing the electric contact surface. The resilient member has one end connected to the first holder, and another end connected to the second holder. The second holder is movable relative to the first holder in the third direction between a first position and a second position. As the second holder moves from the first position to the second position, the resilient member expands to generate contraction force functioning as pressing force acting in a direction from the second position toward the first position.

16 Claims, 20 Drawing Sheets

(56) References Cited

U.S. PATENT DOCUMENTS

| | | | | |
|---|---|---|---|---|
| 2013/0051849 | A1 | 2/2013 | Itabashi et al. | |
| 2015/0037059 | A1 | 2/2015 | Yang et al. | |
| 2015/0261177 | A1 | 9/2015 | Moon et al. | |
| 2016/0349697 | A1 | 12/2016 | Wei et al. | |
| 2017/0269543 | A1* | 9/2017 | Itabashi ..... | G03G 21/1652 |

FOREIGN PATENT DOCUMENTS

| | | | |
|---|---|---|---|
| JP | 2011-059510 | A | 3/2011 |
| JP | 2011-118119 | A | 6/2011 |
| JP | 2013-054058 | A | 3/2013 |
| JP | 3196279 | U | 3/2015 |

OTHER PUBLICATIONS

Extended European Search Report issued in related European Patent Application No. 17193971.3, dated Feb. 23, 2018.

* cited by examiner

DEVELOPING CARTRIDGE INCLUDING HOLDER THAT HOLDS ELECTRICAL CONTACT SURFACE

CROSS REFERENCE TO RELATED APPLICATION

This application claims priority from Japanese Patent Application No. 2017-067272 filed Mar. 30, 2017. The entire content of the priority application is incorporated herein by reference.

TECHNICAL FIELD

The present disclosure relates to a developing cartridge.

BACKGROUND

Conventionally, electrophotographic image-forming apparatuses such as LED printers are well-known in the art. The image-forming apparatuses may use developing cartridges. Such a developing cartridge may include a developing roller configured to supply toner. Such conventional image-forming apparatuses are disclosed in prior arts. For example, a prior art discloses an image-forming apparatus including a drawer unit. The drawer unit includes a photosensitive drum. A developing cartridge is configured to be attached to the drawer unit. When the developing cartridge is attached to the drawer unit, the photosensitive drum and the developing roller contact each other.

Another prior art discloses a developing cartridge that is configured to be attached to a drum cartridge. The drum cartridge includes a photosensitive drum. When the developing cartridge is attached to the drum cartridge, the photosensitive drum and the developing roller contact each other. The drum cartridge having the developing cartridge attached thereto is attached to an image-forming apparatus.

SUMMARY

Conventionally, there has been also known a developing cartridge having a storage medium. The storage medium may be an IC chip, for example. The storage medium includes an electrical contact surface. The electrical contact surface of the storage medium is configured to contact a terminal provided in an image-forming apparatus. However, the electrical contact surface may be rubbed with a portion of the image-forming apparatus at the time of attachment of the developing cartridge to the image-forming apparatus.

In view of the foregoing, it is an object of the disclosure to provide a structure that can reduce rubbing of an electrical contact surface when a developing cartridge having the electrical contact surface is mounted in a frame.

In order to attain the above and other objects, the disclosure provides a developing cartridge including a housing, a developing roller, a storage medium, a resilient member, a first holder and a second holder. The housing is configured to accommodate therein developer. The developing roller is rotatable about a first axis extending in a first direction. The developing roller is positioned at one end of the housing in a second direction. The storage medium includes an electric contact surface. The resilient member is positioned at one end of the housing in the first direction, the resilient member being configured to expand and contract in a third direction crossing the electric contact surface. The first holder is positioned at the one end of the housing in the first direction, and one end of the resilient member in the third direction is connected to the first holder. The second holder holds the electric contact surface. Another end of the resilient member in the third direction is connected to the second holder. The second holder is movable relative to the first holder in the third direction between a first position and a second position closer to the first holder than the first position is to the first holder. In a case where the second holder moves from the first position to the second position, the resilient member expands and pressing force acting in a direction from the second position toward the first position is generated by contraction force of the expanded resilient member.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
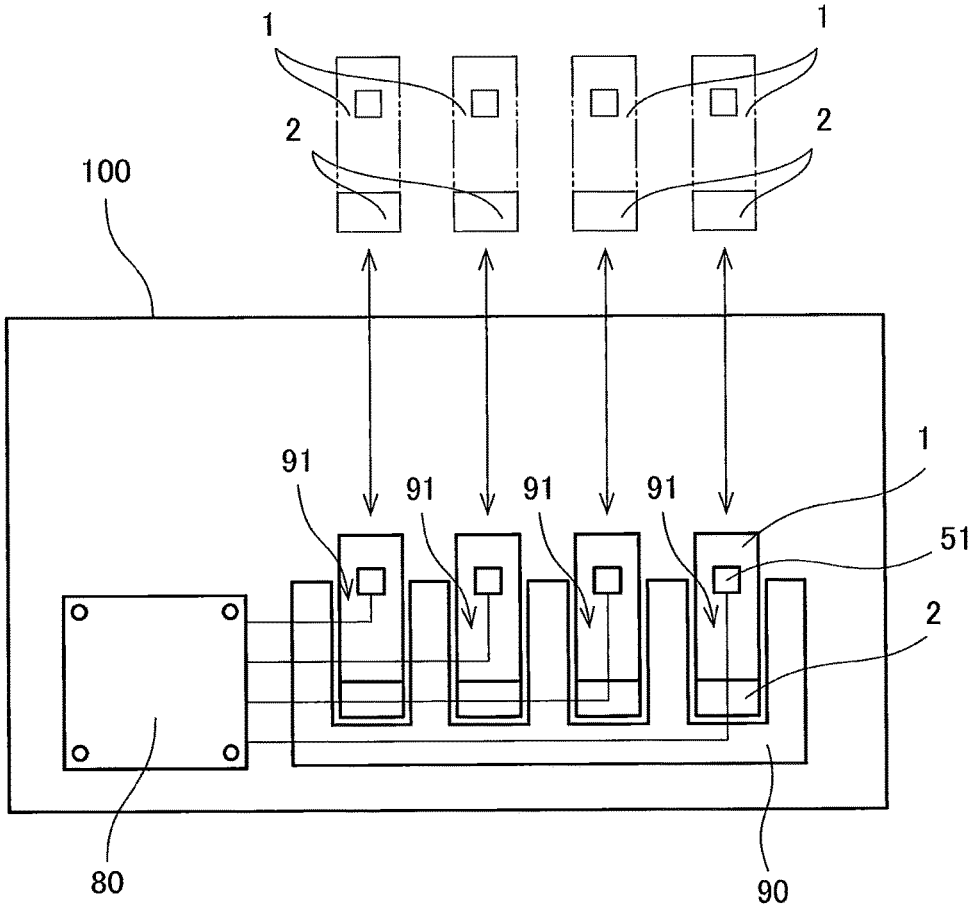
FIG. 1 is a conceptual diagram of an image-forming apparatus according to a first embodiment.

Hereinafter, embodiments of the present disclosure will be described in detail with reference to accompanying drawings, wherein like parts and components are designated by the same reference numerals to avoid duplicating description.

1. First Embodiment

1-1. Configuration of Image-Forming Apparatus 2

FIG. 1 is a conceptual view of an image-forming apparatus 100 as an example of an image-forming apparatus according to a first embodiment. The image-forming apparatus 100 is an electrophotographic printer. For example, the image-forming apparatus 100 may be a laser printer, or an LED printer.

The image-forming apparatus 100 includes four developing cartridges 1, four drum cartridges 2, and a cartridge holder 90.

The developing cartridges 1 are configured to be attached to the respective drum cartridges 2. The developing cartridges 1, which are attached to the corresponding drum cartridges 2, are configured to be mounted to the cartridge holder 90. The four developing cartridges 1 respectively store developer of different colors (for example, cyan, magenta, yellow, and black). However, the number of the developing cartridges 1 may be one to three, or more than five. The cartridge holder 90 is a frame in which the developing cartridges 1 attached to drum cartridges 2 are configured to be mounted. The cartridge holder 90 includes four slots 91. The developing cartridges 1 attached to the corresponding drum cartridges 2 are configured to be mounted to the respective slots 91. The image-forming apparatus 100 is configured to form an image on a recording surface of a printing sheet using developer (toner, for example) supplied from each of the developing cartridges 1.

Each of the four developing cartridges 1 includes an IC chip 51. The IC chip 51 is a storage medium from or into which information can be read out or written. Further, the image-forming apparatus 100 includes a controller 80. When the developing cartridges 1 attached to the respective drum cartridges 2 are mounted to the respective slots 91, the IC chip 51 of each developing cartridge 1 and the controller 80 are electrically connected to each other. The controller 80 may be configured of a circuit board, for example. The controller 80 includes a processor, such as a CPU, and various memories. holder, wherein, in a case where the second holder moves from the first position to the by allowing various types of processing to be executed in the image-forming apparatus 100.

1-2-1. Developing Cartridge

Figure 2:
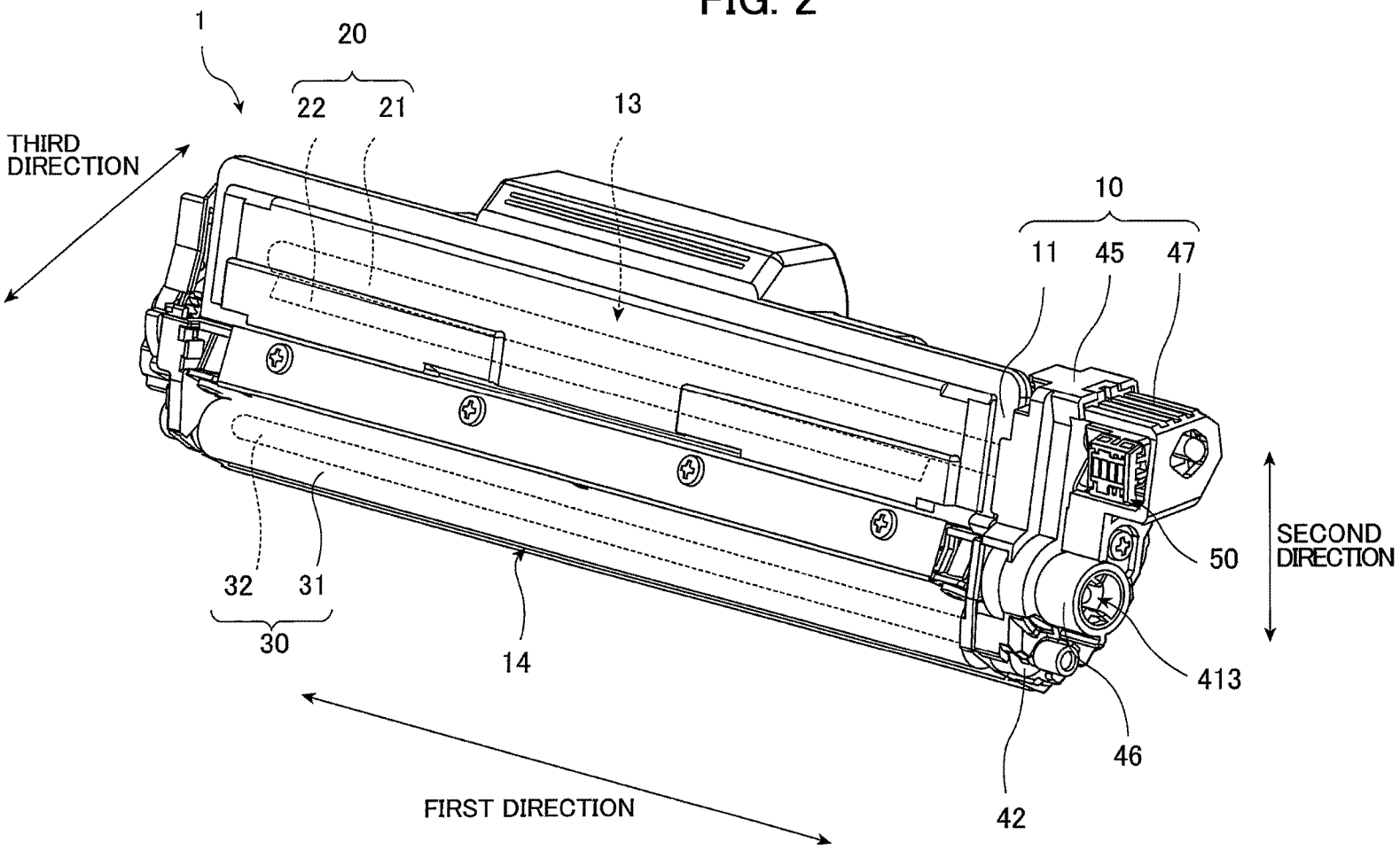
FIG. 2 is a perspective view of a developing cartridge according to the first embodiment.
Figure 3:
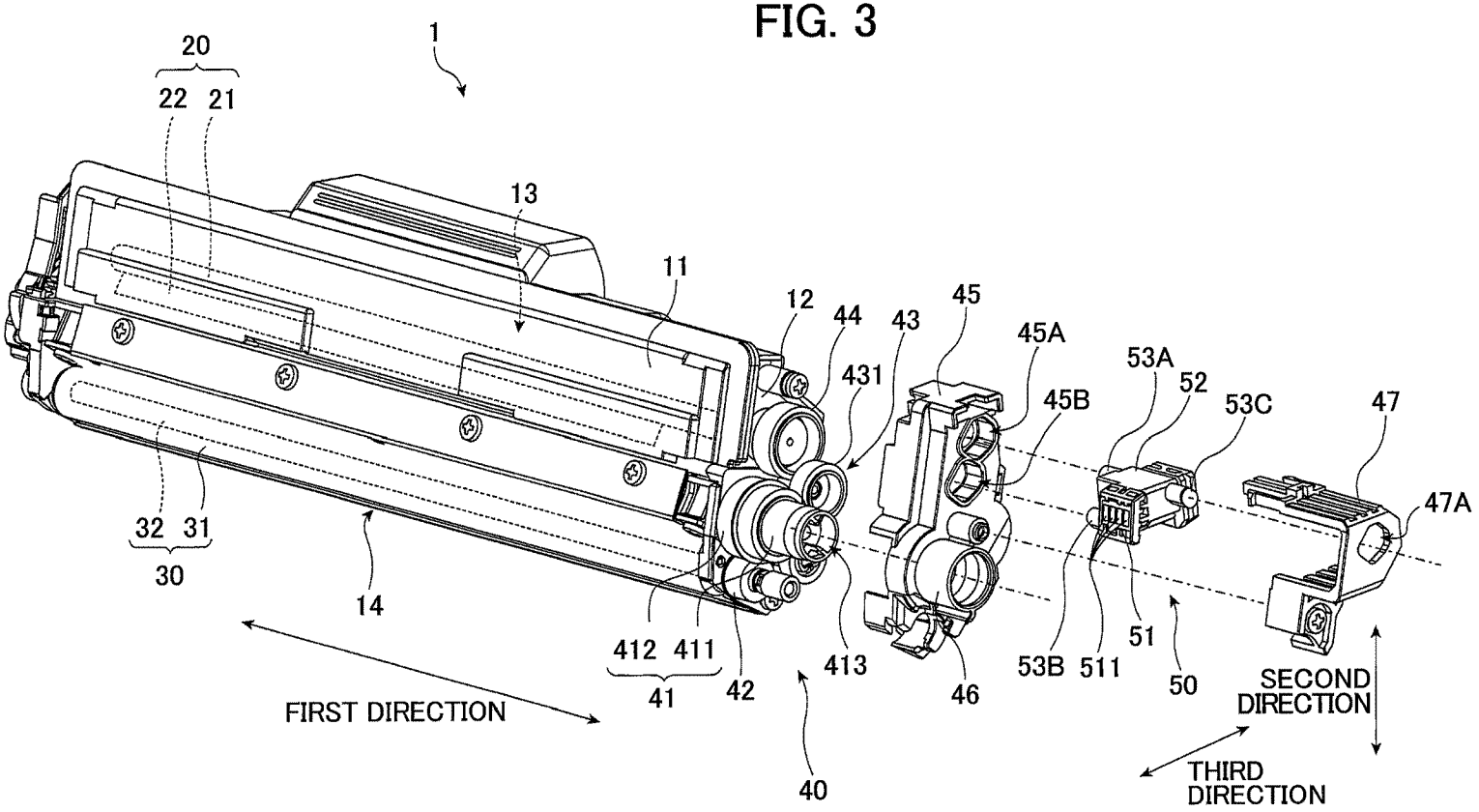
FIG. 3 is an exploded perspective view of the developing cartridge according to the first embodiment.
Figure 4:
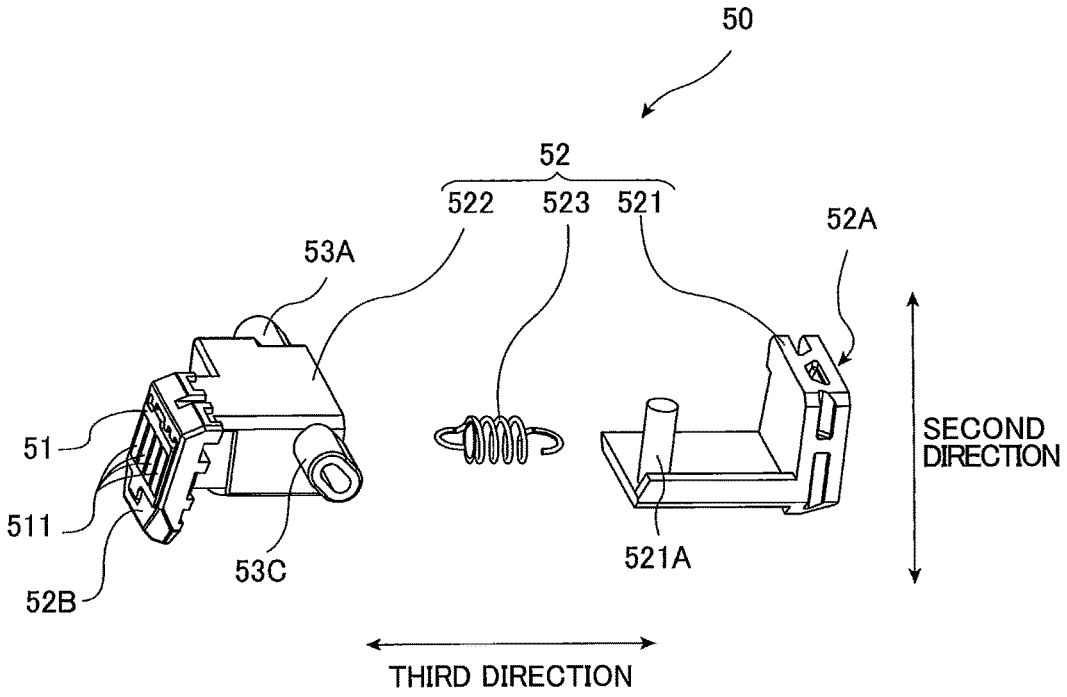
FIG. 4 is an exploded perspective view of an IC chip assembly of the developing cartridge according to the first embodiment.

FIG. 2 is a perspective view of the developing cartridge 1. FIG. 3 is an exploded perspective view of the developing cartridge 1. FIG. 4 is an exploded perspective view of an IC chip assembly 50. As illustrated in FIGS. 2 and 3, each developing cartridge 1 includes a casing 11, an agitator 20, a developing roller 30, a gear train 40, and the IC chip assembly 50.

The casing 11 is a housing body extending in one direction and houses developer therein. The casing 11 constitutes a housing 10 of the developing cartridge 1, together with a cover 45 and a holder cover 47 which will be described later. Hereinafter, a direction in which a rotational axis of the developing roller 30 extends will be referred to as a "first direction". Further, a direction in which the developing roller 30 and the agitator 20 are aligned with one another will be referred to as a "second direction". The first direction and the second direction cross each other. Preferably, first direction and the second direction are perpendicular to each other. The developing roller 30 is positioned at one end of the casing 11 in the second direction. The second direction is coincident with an insertion direction of the developing cartridge 1 into the corresponding slot 91 of the image-forming apparatus 100. Further, a direction crossing an electrical contact surface 511 (described later) of the IC chip 51 will be referred to as a "third direction". The third direction crosses the first direction and the second direction. Preferably, the third direction is perpendicular to the first direction and the second direction, respectively.

An accommodation chamber 13 is provided inside the casing 11. The developer is accommodated in the accommodation chamber 13. The casing 11 includes an opening 14. The opening 14 is positioned at the one end of the casing 11 in the second direction. Each developing cartridge 1 is configured to be attached to the corresponding drum cartridge 2 with the opening 14 facing the drum cartridge 2. The accommodation chamber 13 communicates with the outside through the opening 14.

The agitator 20 includes an agitator shaft 21 and an agitating blade 22. The agitator shaft 21 extends in the first direction. The agitating blade 22 extends radially outward from the agitator shaft 21. At least a portion of the agitator shaft 21 and the agitating blade 22 are positioned in the accommodation chamber 13. An agitator gear 44 illustrated in FIG. 3 is fitted to one end of the agitator shaft 21 in the first direction. The agitator shaft 21 and the agitating blade 22 are configured to rotate together with the agitator gear 44. When the agitating blade 22 rotates, the developer within the accommodation chamber 13 is agitated.

The developing roller 30 is positioned at the one end of the casing 11 in the second direction. The second direction is coincident with the insertion direction of the developing cartridge 1 into the corresponding slot 91 of the image-forming apparatus 100. The developing roller 30 is rotatable about the rotational axis extending in the first direction. The developing roller 30 is positioned at the opening 14 of the casing 11.

The developing roller 30 includes a developing-roller body 31 and a developing-roller shaft 32. The developing-roller body 31 is a cylindrical member extending in the first direction. For example, the developing-roller body 31 is made of rubber having elasticity. The developing-roller shaft 32 is a columnar member penetrating the developing-roller body 31 in the first direction. For example, the developing-roller shaft 32 is made of metal or electrically conductive resin. The developing-roller body 31 is fixed to the developing-roller shaft 32 so as to incapable of rotating relative to the developing-roller shaft 32.

A developing-roller gear 42 is fitted to one end of the developing-roller shaft 32 in the first direction. The one end of the developing-roller shaft 32 in the first direction is fixed to the developing-roller gear 42 illustrated in FIG. 3 so as not to rotate relative to the developing-roller gear 42. When the developing-roller gear 42 rotates, the developing-roller shaft 32 also rotates, thereby enabling the developing-roller body 31 to rotate together with the developing-roller shaft 32.

The developing-roller shaft 32 may not necessarily penetrate the developing-roller body 31 in the first direction. For example, the developing-roller shaft 32 may extend in the first direction from both ends of the developing-roller body 31 in the first direction.

Each developing cartridge 1 further includes a supply roller (not illustrated). The supply roller is positioned inside the accommodation chamber 13 and is positioned between the developing roller 30 and the agitator 20. The supply roller is rotatable about a rotational axis extending in the first direction. When the developing cartridge 1 receives drive force, the developer is configured to be supplied from the accommodation chamber 13 in the casing 11 to an outer peripheral surface of the developing roller 30 through the supply roller. At this time, the developer is frictionally charged between the supply roller and the developing roller 30. On the other hand, a bias voltage is applied to the developing-roller shaft 32 of the developing roller 30. Thus, the developer is attracted to the outer peripheral surface of the developing-roller body 31 by electrostatic force between the developing-roller shaft 32 and the developer.

Each developing cartridge 1 further includes a layer-thickness regulating blade (not illustrated). The layer-thickness regulating blade is configured to form the developer supplied to the outer peripheral surface of the developing-roller body 31 into a layer of a certain thickness. Thereafter, the developer on the outer peripheral surface of the developing-roller body 31 is supplied to a photosensitive drum 72 (described later) provided in the corresponding drum cartridge 2. At this time, the developer is moved from the developing-roller body 31 to the photosensitive drum 72 according to an electrostatic latent image formed on an outer peripheral surface of the photosensitive drum 72. As a result, the electrostatic latent image is developed into a visible image on the outer peripheral surface of the photosensitive drum 72.

The gear train 40 is positioned at a first end face 12. The first end face 12 is an outer surface of one end of the casing 11 in the first direction. As illustrated in FIG. 3, the gear train 40 includes a coupling 41, the developing-roller gear 42, an idle gear 43, the agitator gear 44, and the cover 45. In FIG. 3, a plurality of gear teeth of each gear are not illustrated.

The coupling 41 is a gear that is configured to first receive the drive force supplied from the image-forming apparatus 100. The coupling 41 is configured to rotate about a rotational axis extending in the first direction. The coupling 41 includes a coupling portion 411 and a coupling gear 412. In FIG. 3, the coupling gear 412 is illustrated as a two-stage gear. The coupling portion 411 and coupling gear 412 are integrally formed of resin, for example. The coupling portion 411 includes a coupling hole 413 recessed in the first direction. A plurality of gear teeth is provided over an entire outer circumferential portion of the coupling gear 412 at equal intervals.

When the developing cartridges 1 attached to the corresponding drum cartridges 2 are mounted to the image-forming apparatus 100, a drive shaft of the image-forming apparatus 100 is inserted into each of the coupling holes 413. As a result, the drive shaft and the coupling portion 411 are connected to each other so as not to rotate relative to each other. Accordingly, in accordance with rotation of the drive shaft, the coupling portion 411 rotates, thereby causing the coupling gear 412 to rotate together with the coupling portion 411.

The developing-roller gear 42 is a gear for rotating the developing roller 30. The developing-roller gear 42 is rotatable about a rotational axis extending in the first direction. A plurality of gear teeth is provided over an entire outer circumferential portion of the developing-roller gear 42 at equal intervals. Some of the plurality of gear teeth of the coupling gear 412 engage with some of the plurality of gear teeth of the developing-roller gear 42. The developing-roller gear 42 is fixed to the one end of the developing-roller shaft 32 in the first direction so as not to rotate relative to the developing-roller shaft 32. Accordingly, in accordance with rotation of the coupling gear 412, the developing-roller gear 42 rotates, thereby causing the developing roller 30 to rotate together with the developing-roller gear 42.

The idle gear 43 is a gear for transmitting rotation of the coupling gear 412 to the agitator gear 44. The idle gear 43 is rotatable about a rotational axis extending in the first direction. The idle gear 43 includes a large-diameter gear portion 431 and a small-diameter gear portion (not illustrated). The large-diameter gear portion 431 and the small-diameter gear portion are arranged in the first direction. The small-diameter gear portion is positioned between the large-diameter gear portion 431 and the first end face 12 of the casing 11. In other words, the large-diameter gear portion 431 is spaced farther away from the first end face 12 than the small-diameter gear portion is from the first end face 12. A diameter of an addendum circle of the small-diameter gear portion is smaller than a diameter of an addendum circle of the large-diameter gear portion 431. The large-diameter gear portion 431 and the small-diameter gear portion are integrally formed of resin, for example.

The agitator gear 44 is a gear for rotating the agitator 20. The agitator gear 44 is rotatable about a rotational axis extending in the first direction. A plurality of gear teeth is provided over an entire outer circumferential portion of the agitator gear 44 at equal intervals. The agitator gear 44 is fitted to one end of the agitator shaft 21 in the first direction. The agitator gear 44 is fixed to the one end of the agitator shaft 21 in the first direction so as not to rotate relative to the agitator shaft 21. Accordingly, when the drive force is transmitted from the coupling 41 to the agitator gear 44 through the idle gear 43, the agitator gear 44 rotates, thereby causing the agitator 20 to rotate together with the agitator gear 44.

The cover 45 is fixed to the first end face 12 by screwing, for example. The coupling gear 412, the developing-roller gear 42, the idle gear 43, and the agitator gear 44 are accommodated between the first end face 12 and the cover 45. The cover 45 includes a cylindrical collar 46 extending in the first direction. The coupling portion 411 is fitted into the collar 46, such that the coupling hole 413 is exposed to the outside of the cover 45. The developing cartridge 1 further includes the holder cover 47. The holder cover 47 is fixed to the cover 45. The holder cover 47 is positioned opposite to the casing 11 with respect to the cover 45 in the first direction.

As illustrated in FIGS. 3 and 4, a second holder member 522 (described later) of the IC chip assembly 50 includes a boss 53A, a boss 53B, and a boss 53C. As illustrated in FIGS. 3 and 4, the boss 53A, boss 53B and boss 53C are provided on outer surfaces of the second holder member 522 that cross the first direction. The boss 53A and boss 53B are provided on the outer surface of the second holder member 522 that faces the cover 45. The boss 53A and boss 53B extend in the first direction toward the cover 45 from the outer surface of the second holder member 522. The cover 45 includes a through-hole 45A and a through-hole 45B. The through-hole 45A and the through-hole 45B penetrate the cover 45 in the first direction. The boss 53A is inserted into the through-hole 45A. The boss 53B is inserted into the through-hole 45B. Incidentally, the through-hole 45A may be a recess in which the boss 53A can be inserted. Likewise, the through-hole 45B may be a recess in which the boss 53B can be inserted.

As illustrated in FIGS. 3 and 4, the boss 53C is provided on the outer surface of the second holder member 522 that faces the holder cover 47. The boss 53C extends in the first direction toward the holder cover 47 from the outer surface of the second holder member 522. The holder cover 47 includes a through-hole 47A. The through-hole 47A penetrates the holder cover 47 in the first direction. The boss 53C is inserted into the through-hole 47A. The through-hole 47A may be a recess in which the boss 53C can be inserted.

The holder cover 47 is an example of a "holder cover". The boss 53C is an example of a "first boss". The through-hole 47A is an example of a "first recess" and an example of an example of a "first through-hole". The cover 45 is an example of a "gear cover". The boss 53A is an example of a "second boss". The through-hole 45A is an example of a "second recess" and an example of an example of a "second through-hole".

The through-hole 47A has a size (inner dimension) in the second direction that is larger than a size (outer dimension) of the boss 53C in the second direction. The through-hole 45A has a size (inner dimension) in the second direction that is larger than a size (outer dimension) of the boss 53A in the second direction. The through-hole 45B has a size (inner dimension) in the second direction that is larger than a size (outer dimension) of the boss 53B in the second direction. Thus, a holder 52 is movable in the second direction relative to the cover 45 and the holder cover 47 together with the boss 53A, the boss 53B, and the boss 53C. As the holder 52 moves in the second direction, the IC chip 51 having the electrical contact surface 511 also moves in the second direction together with the holder 52.

The through-hole 47A has a size (inner dimension) in the third direction that is larger than a size (outer dimension) of the boss 53C in the third direction. The through-hole 45A has a size (inner dimension) in the third direction that is larger than a size (outer dimension) of the boss 53A in the third direction. The through-hole 45B has a size (inner dimension) in the third direction that is larger than a size (outer dimension) of the boss 53B in the third direction. Thus, the holder 52 is movable in the third direction relative to the cover 45 and the holder cover 47 together with the boss 53A, the boss 53B, and the boss 53C. As the holder 52 moves in the third direction, the IC chip 51 having the electrical contact surface 511 also moves in the third direction together with the holder 52.

Alternatively, the cover 45 may include the bosses 53A and 53B, while the second holder member 522 may include the through holes 45A and 45B. Likewise, alternatively, the holder cover 47 may include the boss 53C, while the second holder member 522 may include the through-hole 47A.

When the electrical contact surface 511 moves in the third direction toward a first outer surface 52A, the electrical contact surface 511 is moved in a direction away from the first outer surface 52A by a contraction force of a coil spring 523. Hereinafter, detailed configurations for moving the electrical contact surface 511 in the third direction will be described. Operations of the coil spring 523 that can move the electrical contact surface 511 will be described in detail using various cross-sectional views.

1-2-2. IC Chip Assembly

Figure 5:
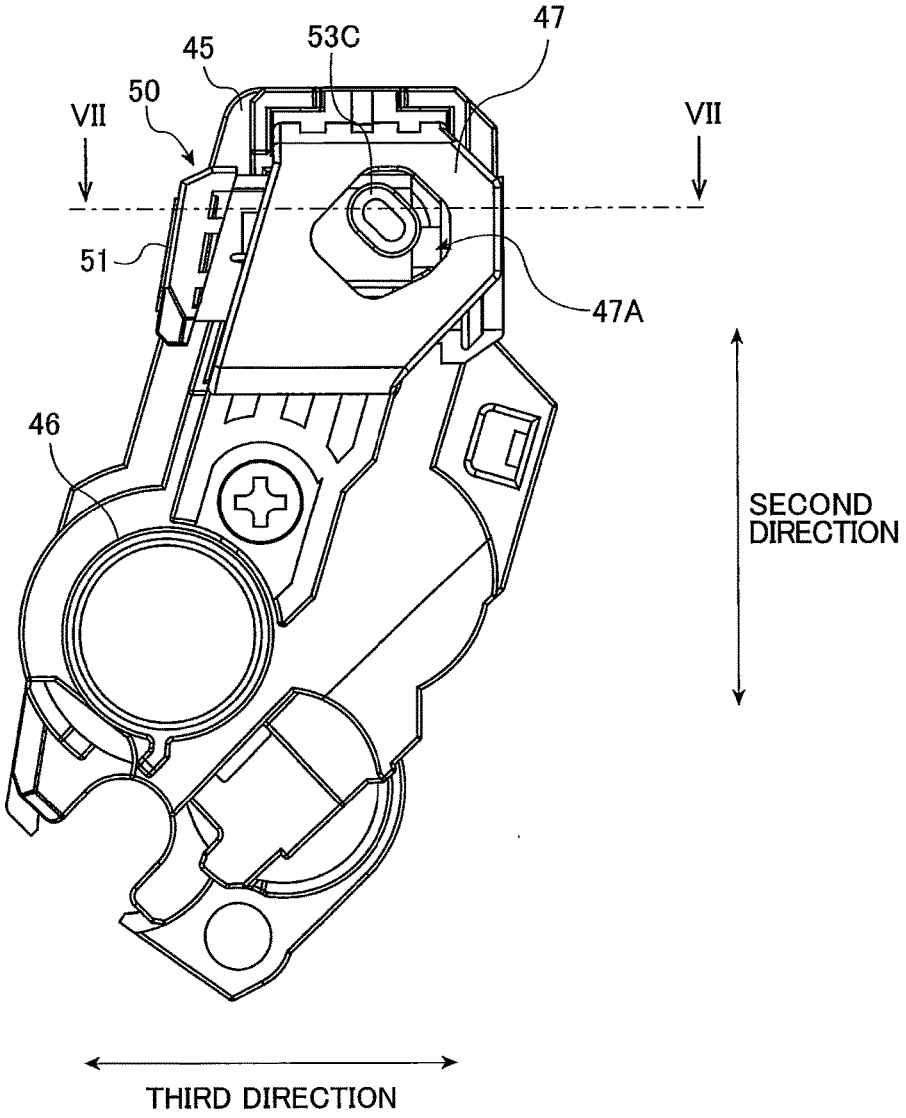
FIG. 5 is a plan view of the developing cartridge according to the first embodiment as viewed from a side of a holder cover thereof in a first direction.
Figure 6:
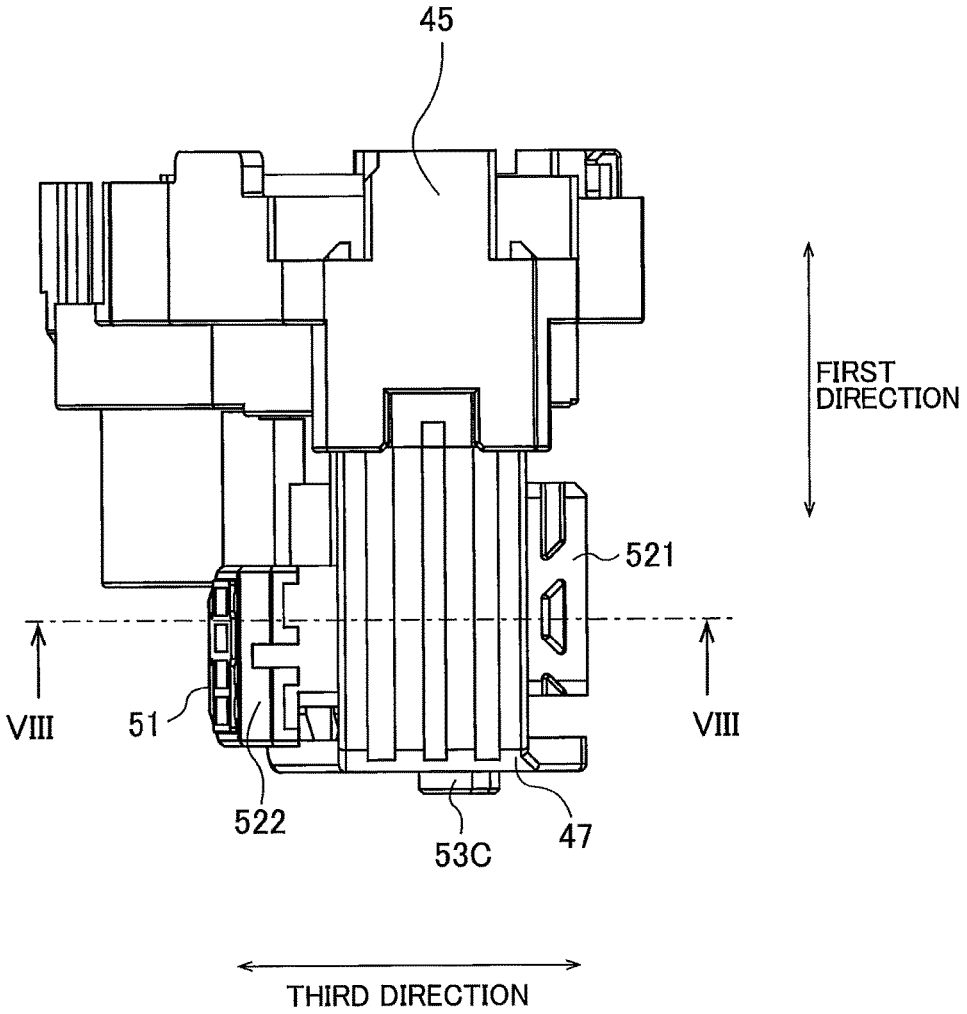
FIG. 6 is a plan view of the developing cartridge according to the first embodiment as viewed from an opposite side of a developing roller in a second direction.
Figure 7:
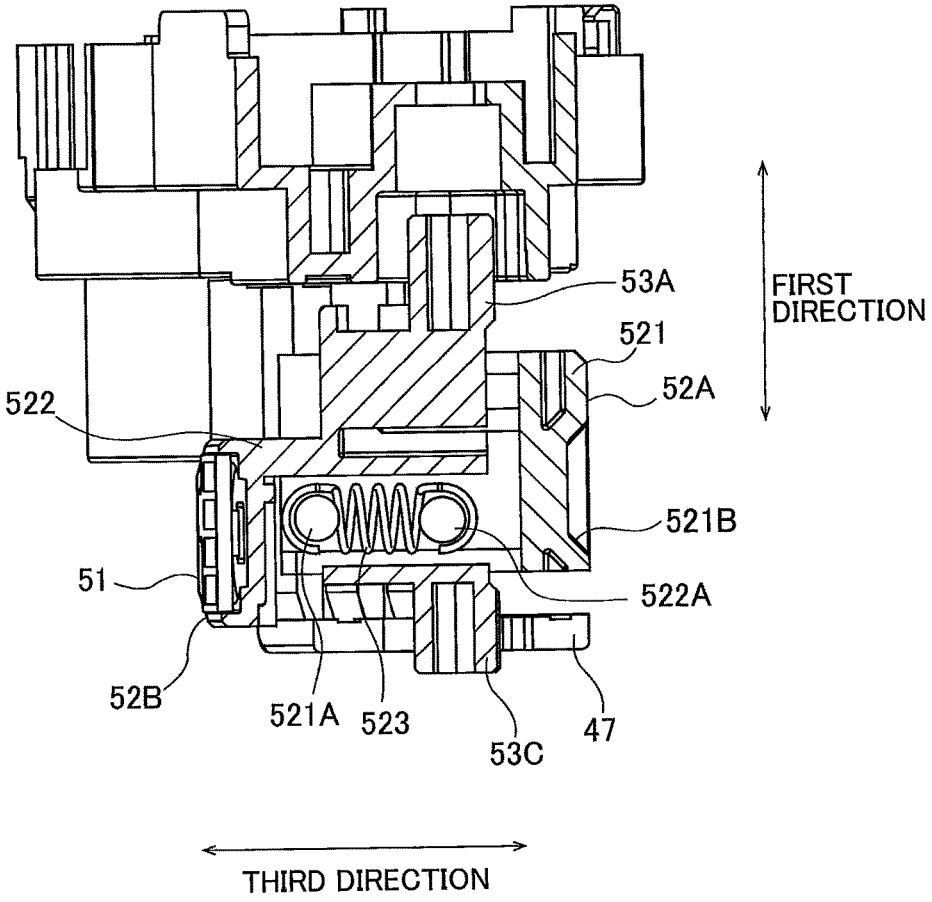
FIG. 7 is a cross-sectional view of the developing cartridge according to the first embodiment taken along a line VII-VII in the FIG. 5.
Figure 8:
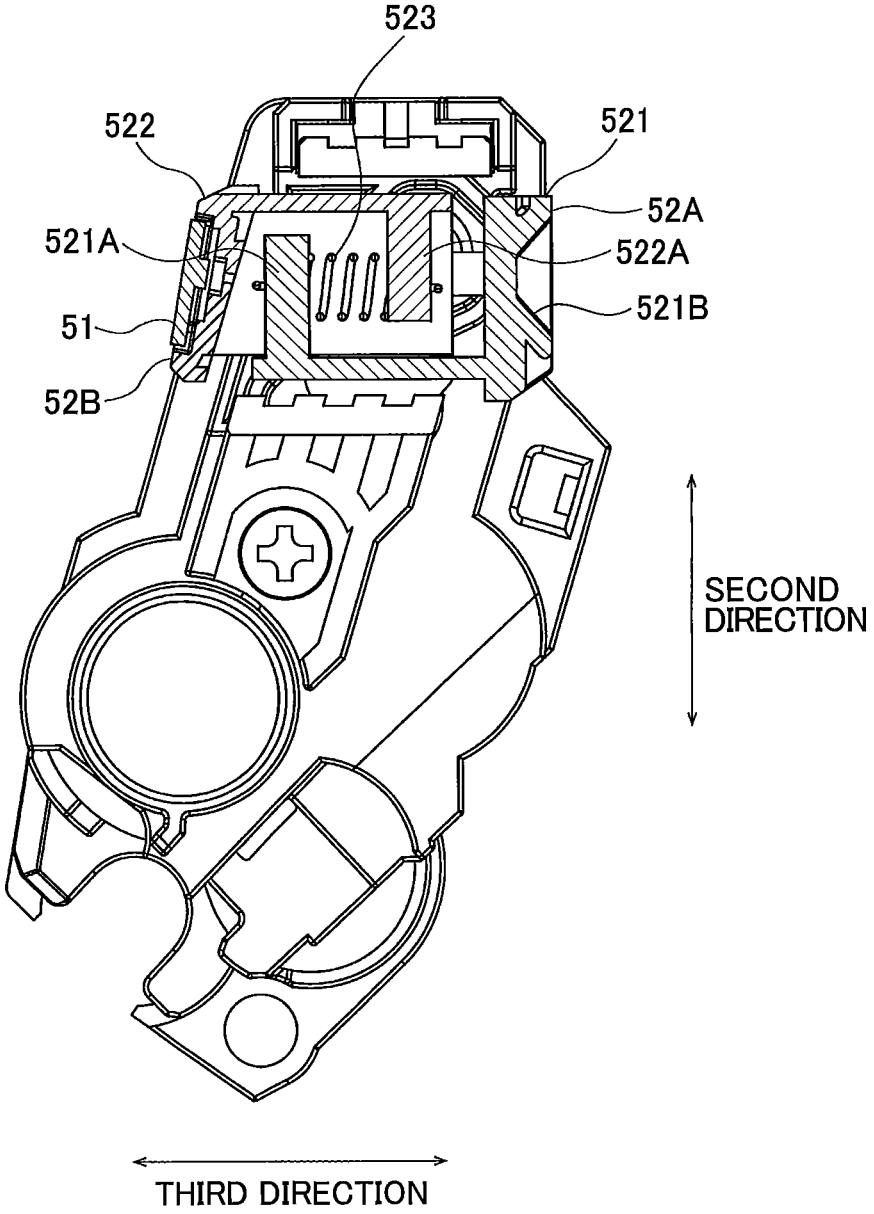
FIG. 8 is a cross-sectional view of the developing cartridge according to the first embodiment taken along a line VIII-VIII in the FIG. 6.

FIG. 5 is a plan view of the developing cartridge 1 as viewed in the first direction from the holder cover 47 side. FIG. 6 is a plan view of the developing cartridge 1 as viewed in the second direction from a side opposite to the developing roller 30. Each of FIGS. 5 and 6 illustrates the cover 45 and the holder cover 47. FIG. 7 is a cross-sectional view taken along a line VII-VII in FIG. 5. FIG. 8 is a cross-sectional view taken along a line VIII-VIII in FIG. 6.

The IC chip assembly 50 includes the IC chip 51 and the holder 52. The IC chip 51 is an example of a storage medium. The holder 52 holds the IC chip 51. The IC chip 51 includes four electrical contact surfaces 511. Each of the electrical contact surfaces 511 is made of metal that is an electrical conductor. The IC chip 51 can store various types of information concerning the developing cartridge 1. The number of the electrical contact surfaces 511 may be one to three or not less than five.

The holder 52 includes a first holder member 521, the second holder member 522, and the coil spring 523. The first holder member 521 and the second holder member 522 are positioned at one end of the housing 10 in the first direction. The first holder member 521 and the second holder member 522 are positioned to oppose each other in the third direction. The coil spring 523 is positioned so as to expand in the third direction. The first holder member 521 is connected to one end of the coil spring 523. The second holder member 522 is connected to the other end of the coil spring 523. That is, the first holder member 521 and the second holder member 522 are connected to each other by the coil spring 523. The first holder member 521 and the second holder member 522 are assembled between the cover 45 and the holder cover 47.

Figure 9:
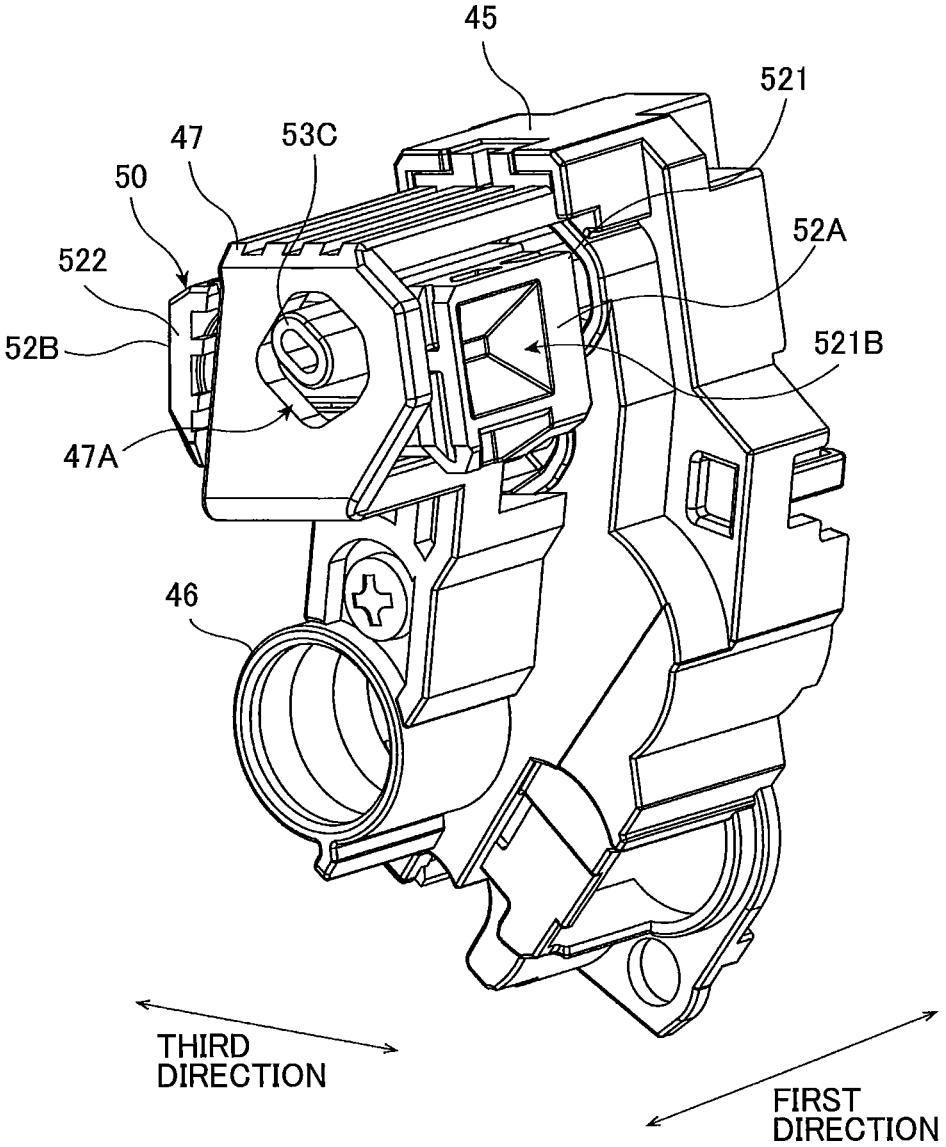
FIG. 9 is a perspective view of the developing cartridge according to the first embodiment as viewed from a side of a first outer surface of a holder in a third direction.

FIG. 9 is a perspective view of the developing cartridge 1 as viewed in the third direction from the first outer surface 52A side of the holder 52. In FIG. 9, the cover 45 and the holder cover 47 are illustrated.

The first holder member 521 includes a recess 521B in the first outer surface 52A. The recess 521B is recessed from the first outer surface 52A toward the second holder member 522. The recess 521B has a substantially quadrangular pyramid shape. Each drum cartridge 2 includes a protrusion 73 (described later) shown in FIG. 10. When the developing cartridges 1 are attached to the corresponding drum cartridges 2, the protrusion 73 of each drum cartridges 2 is fitted into the corresponding recess 521B. The first outer surface 52A of the holder 52 is thus fixed to the corresponding drum cartridge 2. In this state, a second outer surface 52B is movable relative to the fixed first outer surface 52A.

The first holder member 521 is made of resin, for example. As illustrated in FIG. 7 or FIG. 8, the first holder member 521 has one end including the first outer surface 52A of the holder 52 in the third direction, and another end including a boss 521A in the third direction. The boss 521A has a columnar shape extending in the second direction. A gap is provided between the first outer surface 52A and the boss 521A.

The second holder member 522 is made of resin, for example. As illustrated in FIG. 7 or FIG. 8, the second holder member 522 has one end including the second outer surface 52B in the third direction, and another end including a boss 522A in the third direction. The second outer surface 52B holds the IC chip 51. The boss 522A has a columnar shape extending in the second direction. A gap is provided between the second outer surface 52B and the boss 522A.

When the first holder member 521 and the second holder member 522 are assembled, the boss 521A is positioned between the second outer surface 52B and the boss 522A. Further, the boss 522A is positioned between the first outer surface 52A and the boss 521A. At this time, the boss 521A and the boss 522A are spaced apart from each other in the third direction. Further, the coil spring 523 is positioned between the boss 521A and the boss 522A. The coil spring 523 is a resilient member that is configured to expand and contract in the third direction. The one end of the coil spring 523 in the third direction is connected to the boss 521A. The other end of the coil spring 523 in the third direction is connected to the boss 522A. Incidentally, the coil spring 523 may be connected to the boss 521A and the boss 522A, respectively, directly or indirectly through other members.

The coil spring 523 is configured to expand and contract in accordance with movement of the second holder member 522 in the third direction relative to the first holder member 521. Specifically, when the second holder member 522 moves in a direction toward the first holder member 521 in the third direction, the boss 522A moves in a direction away from the boss 521A. As a result, the coil spring 523 connected between the boss 521A and the 522A expands. In the expanded coil spring 523, a contraction force is generated to act in a direction opposite to an expanding direction of the coil spring 523. Due to this contraction force, the boss 522A moves in a direction toward the boss 521A. That is, the second holder member 522 moves in a direction away from the first holder member 521.

The IC chip 51 is held at the second outer surface 52B. That is, the electrical contact surfaces 511 of the IC chip 51 are movable in the third direction in accordance with movement of the second holder member 522 in the third direction relative to the first holder member 521. The electrical contact surfaces 511 are at positions recessed toward the first holder member 521 from the second outer surface 52B in the third direction. The term "hold" used herein includes: a state where the IC chip 51 is fixed to the second outer surface 52B so as not to move relative to the second outer surface 52B; and a state where the IC chip 51 is assembled to the second outer surface 52B so as to allow slight positional fluctuation relative to the second outer surface 52B.

1-2-3. Drum Cartridge

Figure 10:
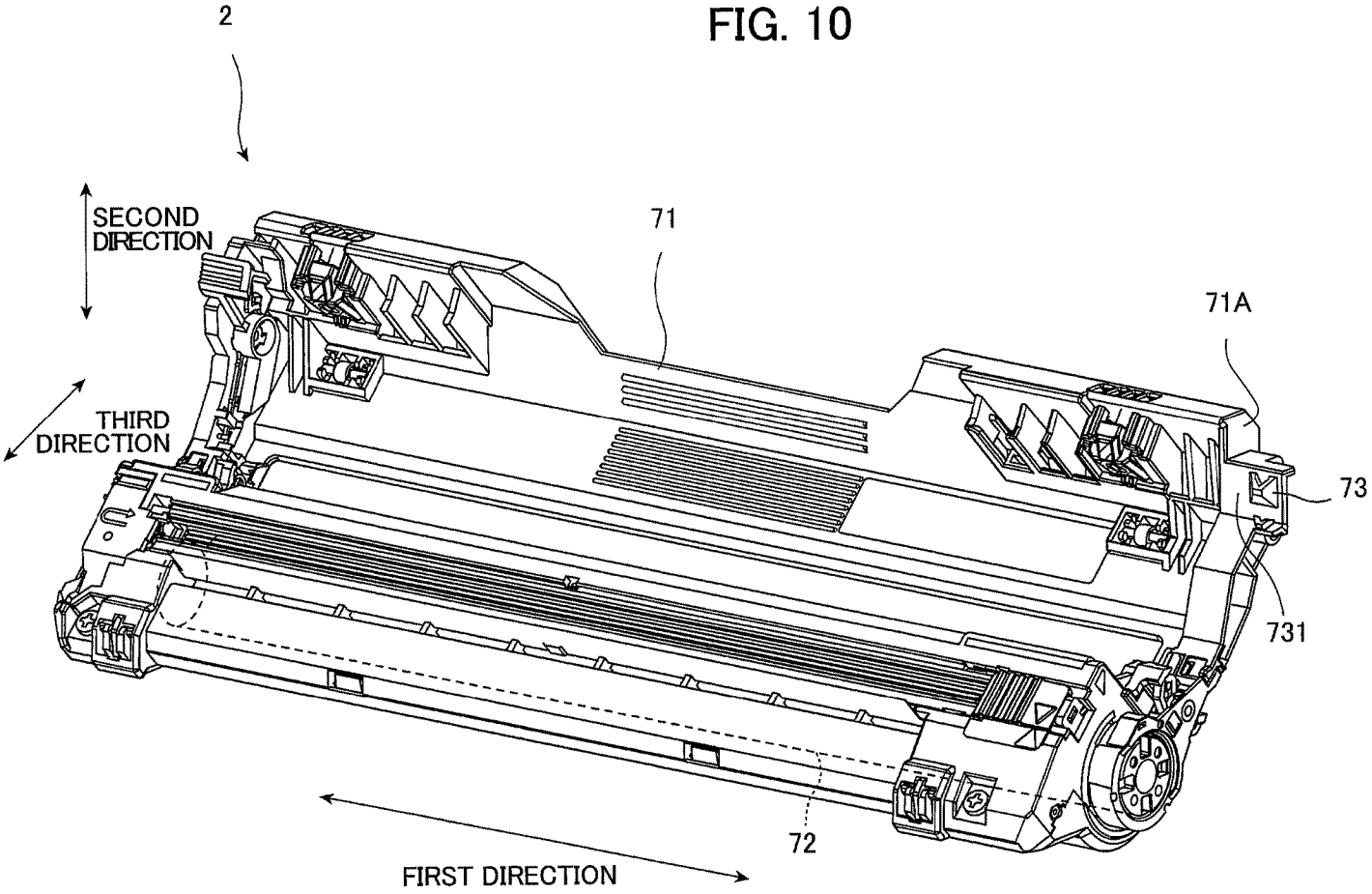
FIG. 10 is a perspective view of a drum cartridge according to the first embodiment.

FIG. 10 is a perspective view of the drum cartridge 2. Each drum cartridge 2 includes a developing-cartridge holding portion 71. Each developing cartridge 1 is attached to the developing-cartridge holding portion 71 of the corresponding drum cartridge 2. Each drum cartridge 2 includes the photosensitive drum 72. The photosensitive drum 72 is rotatable about a rotational axis extending in the first direction. When the developing cartridges 1 are attached to the respective drum cartridges 2, the developing roller 30 of each developing cartridge 1 contacts the photosensitive drum 72 of the corresponding drum cartridge 2. The drum cartridges 2 with the developing cartridge 1 attached thereto is configured to be mounted to the cartridge holder 90 (see FIG. 1).

Each drum cartridge 2 includes a holding plate 731. The holding plate 731 is positioned at a first end face 71A that is one end face of the developing-cartridge holding portion 71 in the first direction. The holding plate 731 is positioned to oppose the first outer surface 52A of the holder 52 in the third direction when the corresponding developing cartridge 1 is attached to the drum cartridge 2. The holding plate 731 has a surface that extends in the first direction and the second direction. The holding plate 731 includes the protrusion 73. The protrusion 73 protrudes from the surface of the holding plate 731 toward the holder 52 in the third direction. The protrusion 73 protrudes toward the holder 52. The protrusion 73 has a quadrangular pyramid shape.

1-3. Insertion of the Developing Cartridge

The developing cartridges 1 attached to the respective drum cartridges 2 are inserted in the second direction into the respective slots 91 of the cartridge holder 90. Hereinafter, the position of the second holder member 522 illustrated in FIGS. 7 and 8 will be referred to as a "first position". The second holder member 522 is at the first position before each developing cartridge 1 is inserted into the corresponding slot 91. At this time, the coil spring 523 has a first length in the third direction which is a natural length of the coil spring 523. However, the first length may be increased or decreased from the natural length to such an extent that resilient force is not generated in the coil spring 523.

Figure 11:
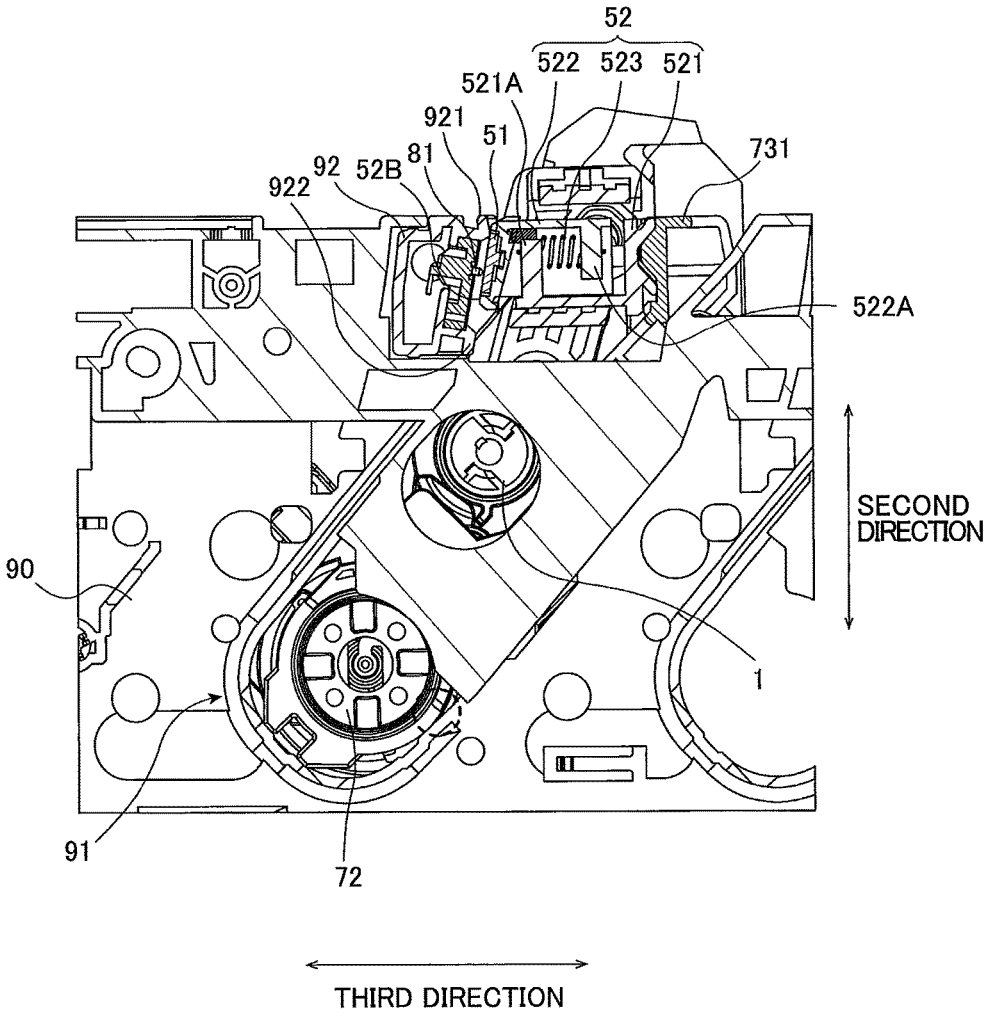
FIG. 11 is a view illustrating a state where the developing cartridge according to the first embodiment is in a process of being inserted into the image-forming apparatus.

FIG. 11 is a view illustrating a state where the developing cartridge 1 is being inserted relative to the image-forming apparatus 100.

The cartridge holder 90 includes four guide portions 92. Each guide portion 92 is positioned at an edge of an insertion opening of each slot 91. Each guide portion 92 supports an electrical connector 81. The electrical connector 81 is an electrical contact made of metal. The electrical connector 81 is configured to contact the electrical contact surfaces 511 of the IC chip 51 of the corresponding developing cartridge 1. The electrical connector 81 protrudes from a surface of the guide portion 92 in the third direction toward the inside of the insertion opening. Each guide portion 92 includes a first protruding portion 921 and a second protruding portion 922 that are arranged in the second direction. The electrical connector 81 is positioned between the first protruding portion 921 and the second protruding portion 922 in the second direction. The first protruding portion 921 is positioned closer to the insertion opening than the electrical connector 81 is to the insertion opening in the second direction. The first protruding portion 921 and the second protruding portion 922 respectively protrude, relative to the electrical connector 81, in the third direction toward the inside of the insertion opening of the corresponding slot 91.

When each developing cartridge 1 is inserted into the corresponding slot 91, the second outer surface 52B of the second holder member 522 contacts the first protruding portion 921. FIG. 11 illustrates a state where the developing cartridge 1 is further inserted into the corresponding slot 91 in the insertion direction after the second outer surface 52B contacts the first protruding portion 921 of the corresponding guide portion 92.

As the developing cartridge 1 is being inserted into the corresponding slot 91 further in the insertion direction, the developing cartridge 1 is guided by a frame (not shown) of the cartridge holder 90. The developing cartridge 1 therefore moves in the third direction, relative to the slot 91, toward the guide portion 92. At this time, the second outer surface 52B of the second holder member 522 is in contact with the first protruding portion 921. Thus, the second holder member 522 does not move toward the guide portion 92. On the other hand, the first holder member 521 moves in the third direction toward the guide portion 92. That is, the first holder member 521 approaches toward the second holder member 522.

As described above with reference to FIG. 8, the first holder member 521 includes the boss 521A. That is, the boss 521A does not move in the third direction. The second holder member 522 includes the boss 522A. That is, the boss 522A moves in the third direction. The boss 521A is positioned closer to the guide portion 92 than the boss 522A is to the guide portion 92 in the third direction. Accordingly, as the first holder member 521 approaches the second holder member 522, the boss 521A moves in a direction away from the boss 522A. As a result, a distance between the boss 521A and the boss 522A is increased, causing the coil spring 523 to expand. The length of the coil spring 523 in the third direction at this time is a second length greater than the first length. A contraction force acting in the third direction is thus generated in the expanded coil spring 523. Due to the contraction force, the second holder member 522 is applied with pressing force acting toward the guide portion 92 in the third direction. Hereinafter, the position of the second holder member 522 relative to the first holder member 521 in the third direction will be referred to as a "second position".

As indicated by a dashed circle in FIG. 11, the photosensitive drum 72 of the drum cartridge 2 contacts the frame of the cartridge holder 90. The photosensitive drum 72 is slidingly movable on the frame. In this way, as the developing cartridge 1 attached to the drum cartridge 2 is inserted into the corresponding slot 91, the developing cartridge 1 is configured to be guided in the insertion direction while being fixed in position with respect to the third direction.

Figure 12:
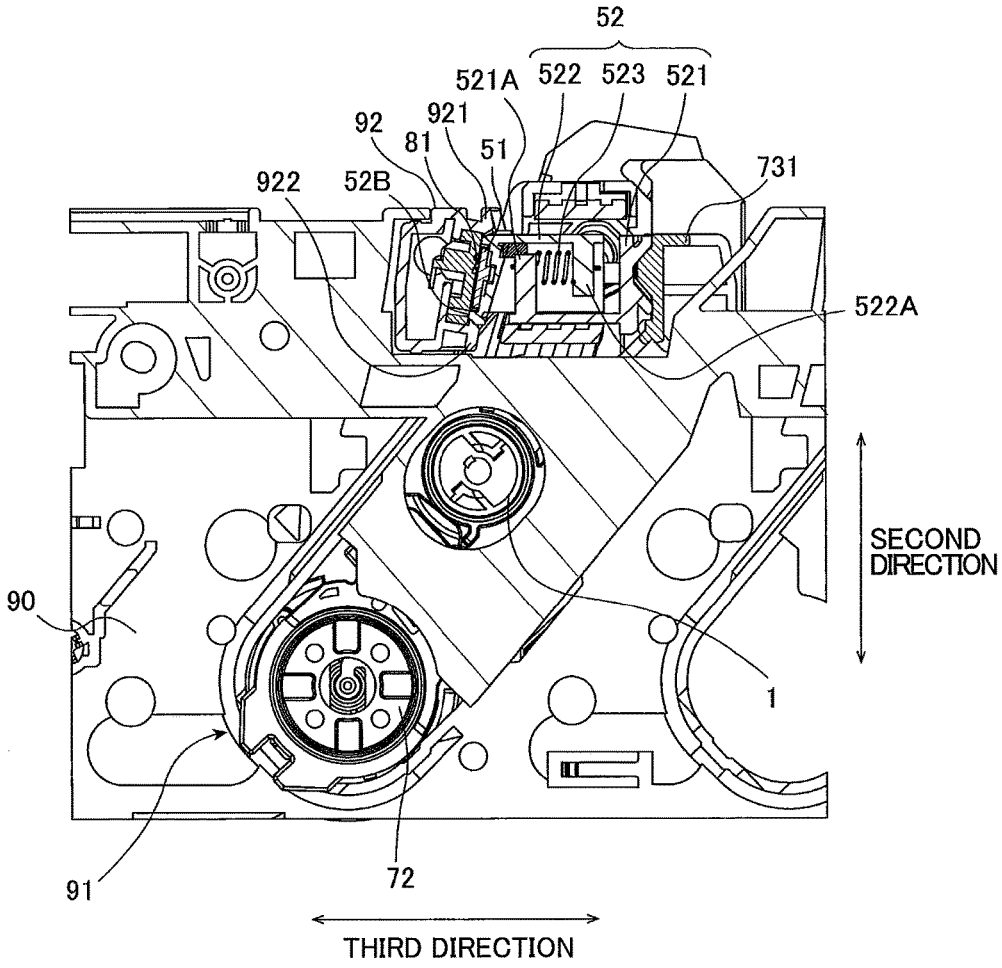
FIG. 12 is a view illustrating a state where insertion of the developing cartridge according to the first embodiment in the image-forming apparatus is completed.

FIG. 12 is a view illustrating a state where the insertion of the developing cartridge 1 relative to the image-forming apparatus 100 has been completed.

When the developing cartridge 1 is further inserted in the insertion direction from the state shown in FIG. 11, the second holder member 522 rides over the first protruding portion 921. The second holder member 522, which has moved past the first protruding portion 921, is moved in the third direction toward the guide portion 92, since the second holder member 522 is applied with pressing force acting in the third direction toward the guide portion 92 by the contraction force of the coil spring 523. The electrical contact surfaces 511 of the IC chip 51 are thus brought into contact with the electrical connector 81.

Hereinafter, the position of the second holder member 522 relative to the first holder member 521 in the third direction in a state where the electrical contact surfaces 511 and the electrical connector 81 contact each other will be referred to as a "third position". When the second holder member 522 is at the third position, the coil spring 523 has a third length in the third direction that is shorter than the second length and greater than the first length. That is, when the second holder member 522 is at the third position, the contraction force continues to be generated in the coil spring 523. The electrical contact surfaces 511 of the IC chip 51 are thus pressed against the electrical connector 81. Thus, contact between the electrical contact surfaces 511 and the electrical connector 81 can be reliably maintained.

As described above, the second outer surface 52B contacts the first protruding portion 921, and rides over the first protruding portion 921 while changing the position thereof in the third direction. Then, after the second outer surface 52B moves past the first protruding portion 921, the electrical contact surfaces 511 directly contact the electrical connector 81. Thus, once the contact is established, there is little change in the contact position of the electrical connector 81 relative to the electrical contact surfaces 511. This structure of the first embodiment can reduce a likelihood that the electrical contact surfaces 511 are rubbed.

In particular, the electrical contact surfaces 511 of the IC chip 51 are positioned in a recessed portion on the second outer surface 52B in the third direction. Thus, the first protruding portion 921 does not contact the electrical contact surfaces 511 during the insertion of the developing cartridge 1. This structure can prevent the electrical contact surfaces 511 from being rubbed by the first protruding portion 921.

Note that, in the first embodiment, the housing 10 is an example of a "housing" of the present disclosure. That is, the casing 11, the cover 45 and holder cover 47 are exemplified as the "housing". However, the casing 11 by itself may be the "housing". Alternatively, the casing 11 and the cover 45 may be the "housing". Still alternatively, the casing 11 and the holder cover 47 may be the "housing".

2. Second Embodiment

Hereinafter, an image-forming apparatus according to a second embodiment will be described. The image-forming apparatus according to the second embodiment differs from that of the first embodiment in the configuration of the IC chip assembly 50. Specifically, the difference between the first embodiment and the second embodiment lies in the structure to hold the coil spring 523 that generates the pressing force acting in the third direction toward the electrical connector 81 on the second holder member 522 that holds the IC chip 51. Specifically, in the image-forming apparatus according to the second embodiment, the first holder member 521 connected to the one end of the coil spring 523 is not provided. Rather, in the second embodiment, the one end of the coil spring 523 is connected to a holder cover 247 constituting a portion of the housing 10 of each developing cartridge 1.

The configurations of the drum cartridge 2 and the cartridge holder 90 are the same as those configurations of the first embodiment.

Hereinafter, structures to move the electrical contact surfaces 511 in the third direction by means of the contraction force of the coil spring 523 according to the second embodiment will be described. Movements of the electrical contact surfaces 511 attributed to the coil spring 523 will be described in detail using various cross-sectional views.

2-1. IC Chip Assembly

Figure 13:
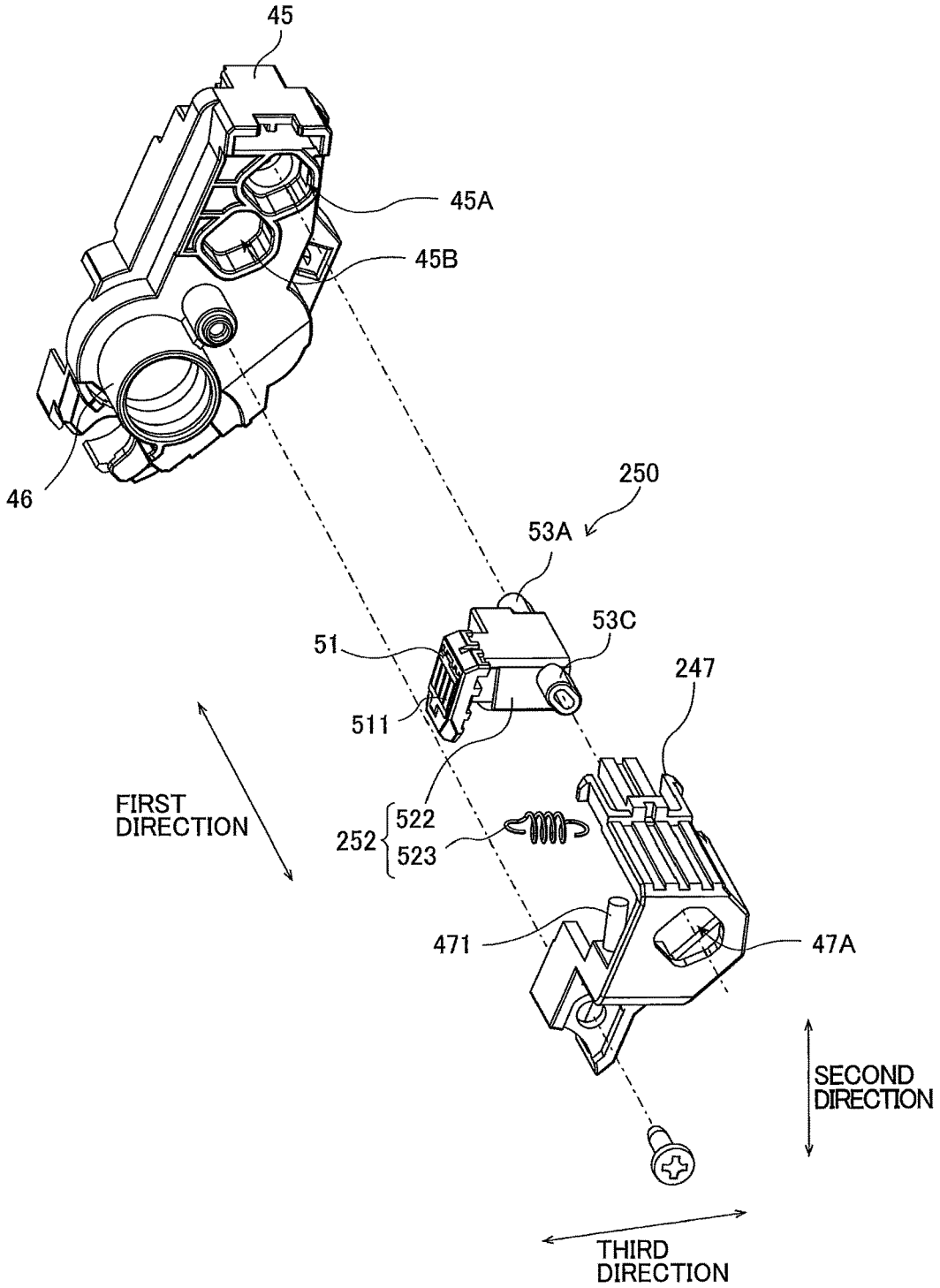
FIG. 13 is an exploded perspective view of a cover and a holder cover according to a second embodiment.
Figure 14:
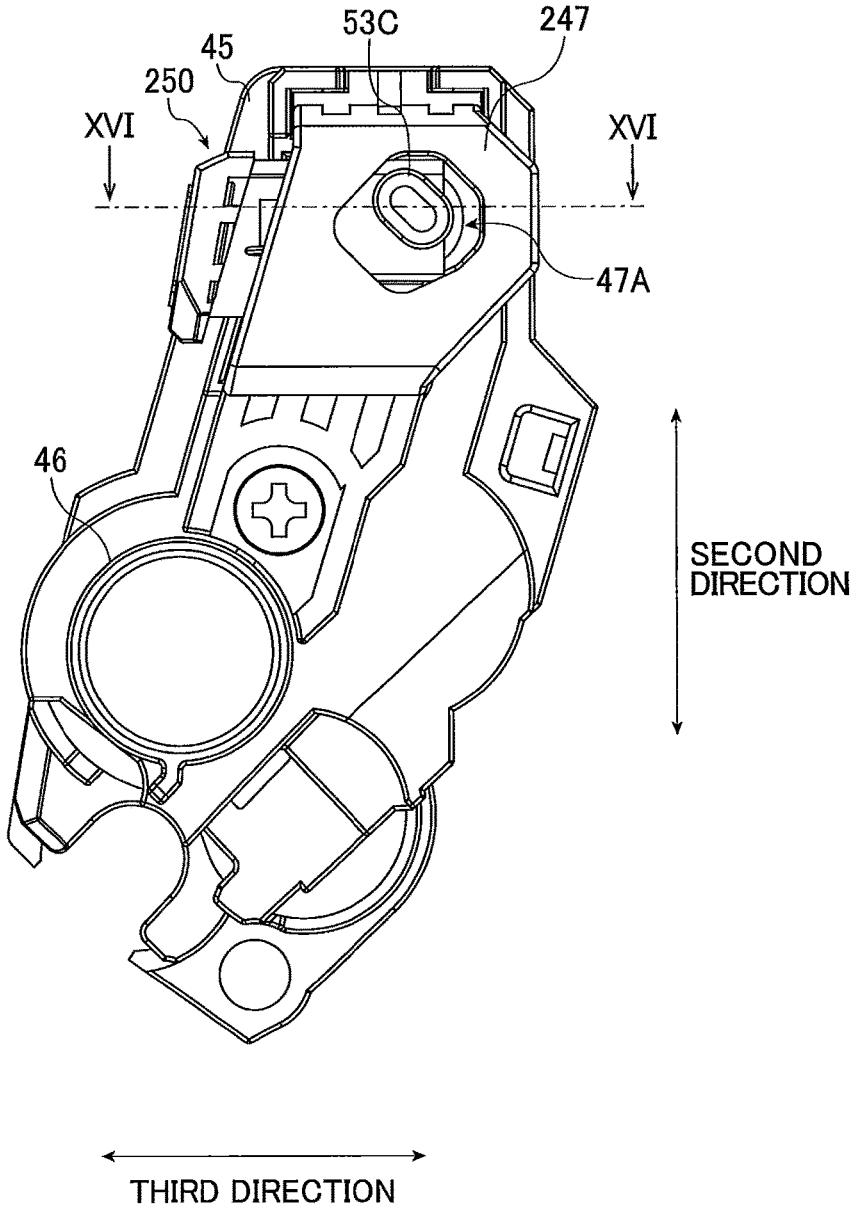
FIG. 14 is a plan view of a developing cartridge according to the second embodiment as viewed from a side of a holder cover thereof in the first direction.
Figure 15:
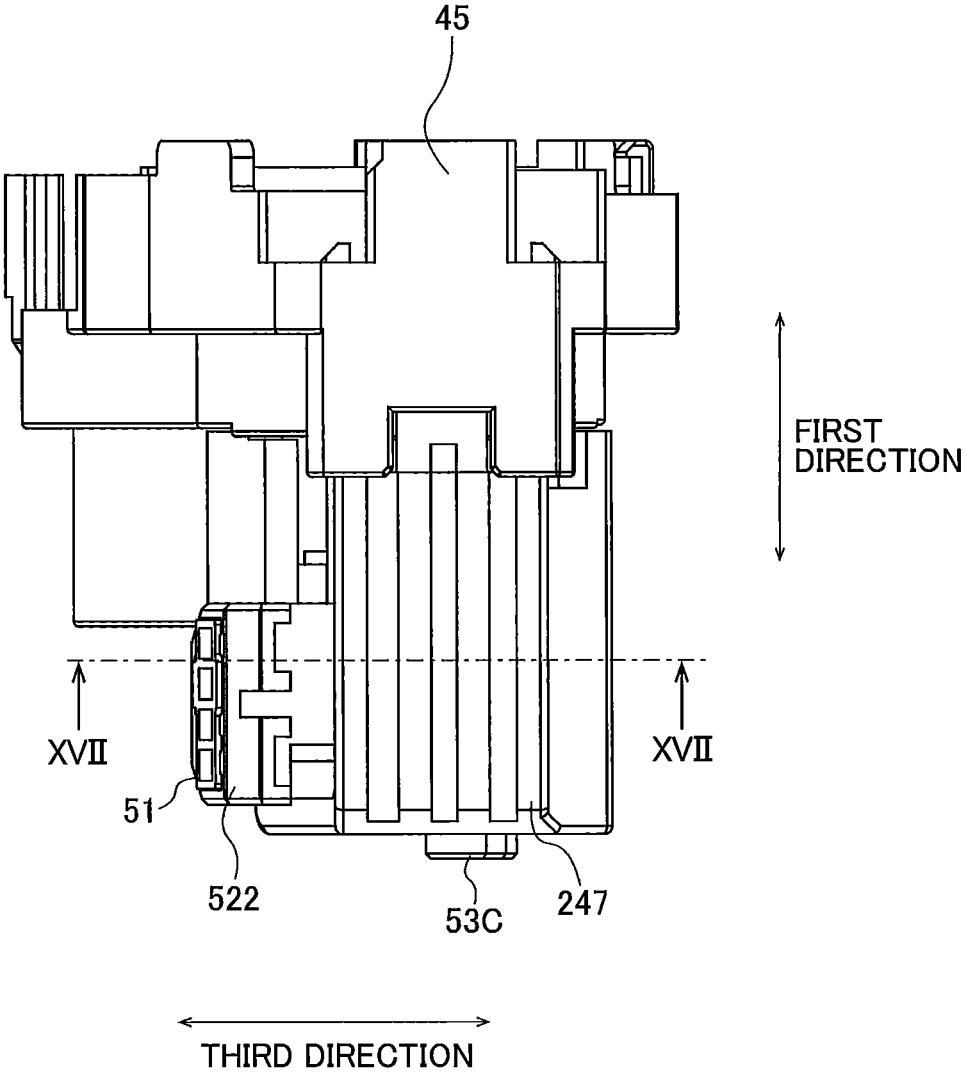
FIG. 15 is a plan view of the developing cartridge according to the second embodiment as viewed from an opposite side of the developing roller in the second direction.
Figure 16:
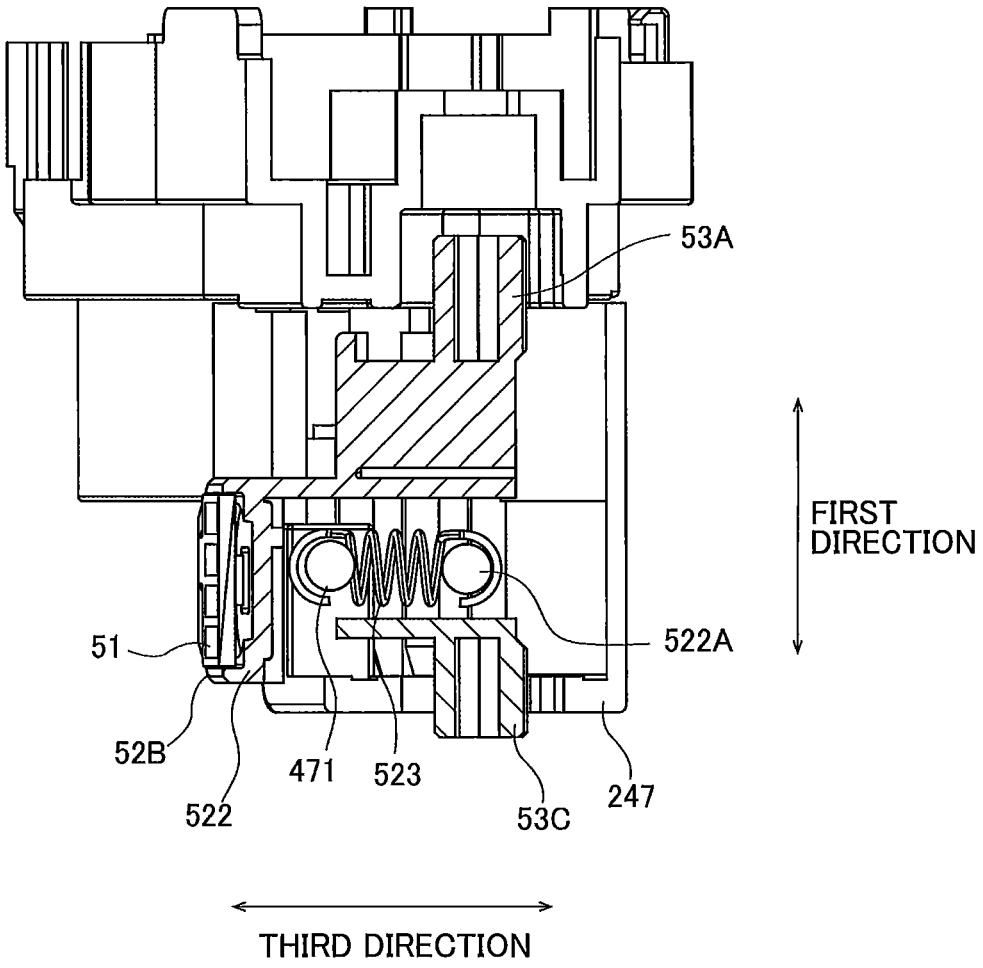
FIG. 16 is a cross-sectional view of the developing cartridge according to the second embodiment taken along a line XVI-XVI in the FIG. 14.
Figure 17:
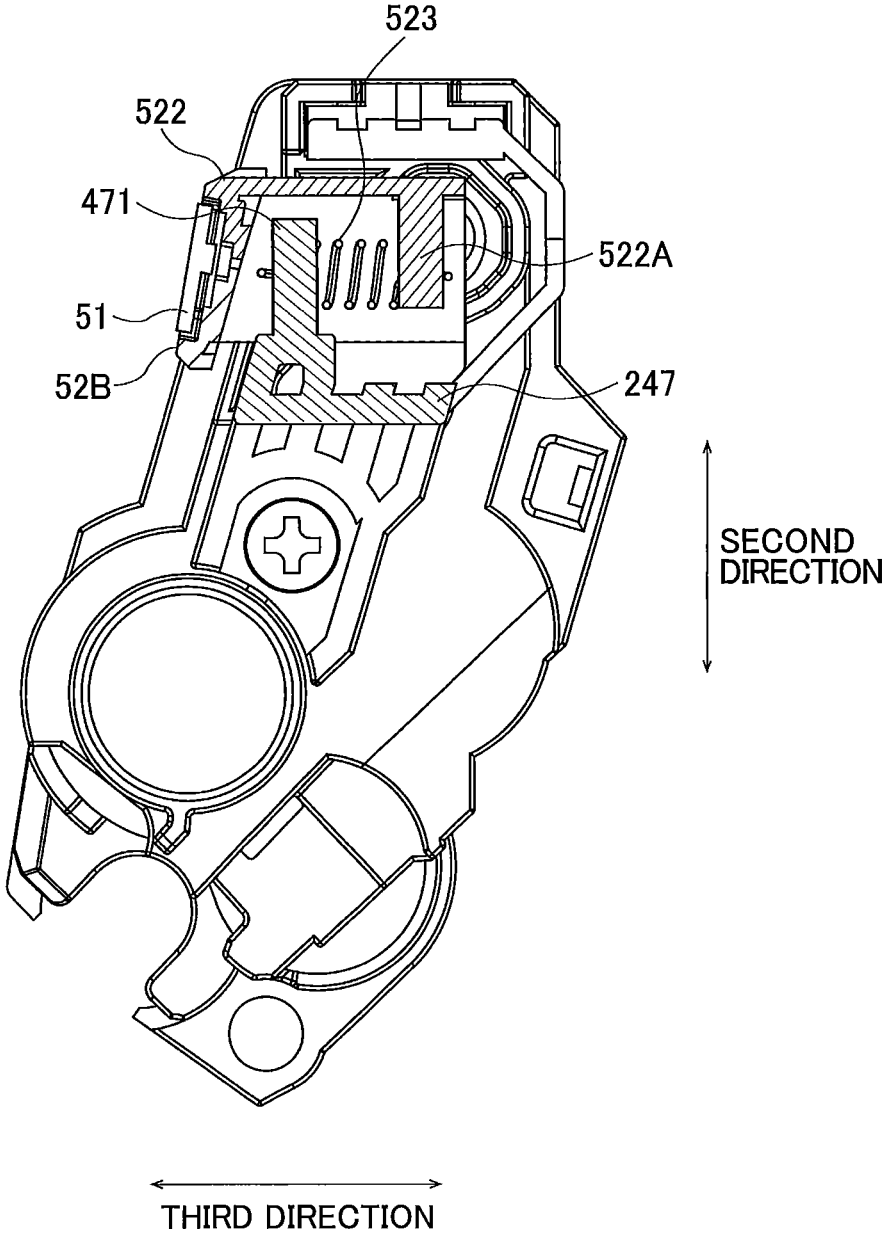
FIG. 17 is a cross-sectional view of the developing cartridge according to the second embodiment taken along a line XVII-XVII in the FIG. 15.

FIG. 13 is an exploded perspective view of the cover 45 and the holder cover 247 disassembled from each other. FIG. 14 is a plan view of the developing cartridge 1 as viewed in the first direction from the holder cover 247 side. FIG. 15 is a plan view of the developing cartridge 1 as viewed in the second direction from the opposite side of the developing roller 30. FIGS. 14 and 15 respectively illustrate the cover 45 and the holder cover 247. FIG. 16 is a cross-sectional view taken along a line XVI-XVI in FIG. 14. FIG. 17 is a cross-sectional view taken along a line XVII-XVII in FIG. 15.

An IC chip assembly 250 of the second embodiment includes the IC chip 51 and a holder 252. The holder 252 of the second embodiment includes the second holder member 522 and the coil spring 523. The configurations of the second holder member 522 and the coil spring 523 are the same as those of the first embodiment, so the descriptions thereof will be omitted. The holder 252 is held between the cover 45 and the holder cover 247 such that the holder 252 is movable in the third direction relative to the cover 45 and the holder cover 247.

The holder cover 247 of the second embodiment is an example of a "first holder". The holder cover 247 includes a boss 471. The boss 471 has a columnar shape extending in the second direction. The second holder member 522 is connected to the holder cover 247 by the coil spring 523. Specifically, as illustrated in FIGS. 16 and 17, the boss 471 is positioned between the second outer surface 52B of the second holder member 522 and the boss 522A in the third direction. At this time, the boss 471 and the boss 522A are spaced apart from each other in the third direction. Further, the coil spring 523 is positioned between the boss 471 and the boss 522A.

The one end of the coil spring 523 in the third direction is connected to the boss 471. The other end of the coil spring 523 in the third direction is connected to the boss 522A. The coil spring 523 may be connected to the boss 471 and the boss 522A directly or indirectly through other members.

As described above, in the present embodiment, the one end of the coil spring 523 is connected to the holder cover 247 which is a portion of the housing 10 of the developing cartridge 1. That is, in the image-forming apparatus according to the present embodiment, the first holder member 521 in the first embodiment is not required. The number of required parts can be reduced. Alternatively, the boss 471 connected to the one end of the coil spring 523 may be provided at the cover 45. The boss 471 may be provided at a member that is fixed to the housing 10.

The coil spring 523 expands and contracts in accordance with movement of the second holder member 522 in the third direction relative to the holder cover 247. Specifically, in case that the second outer surface 52B of the second holder member 522 moves in the third direction toward the holder cover 247, the boss 522A moves in a direction away from the boss 471. The coil spring 523 connected to the boss 471 and the boss 522A expands, accordingly. As a result, a contraction force acting in a direction opposite to the expanding direction of the coil spring 523 is generated in the expanded coil spring 523. By the contraction force, the boss 522A is moved in a direction toward the boss 471. That is, the second outer surface 52B of the second holder member 522 moves in a direction away from the holder cover 247.

Figure 18:
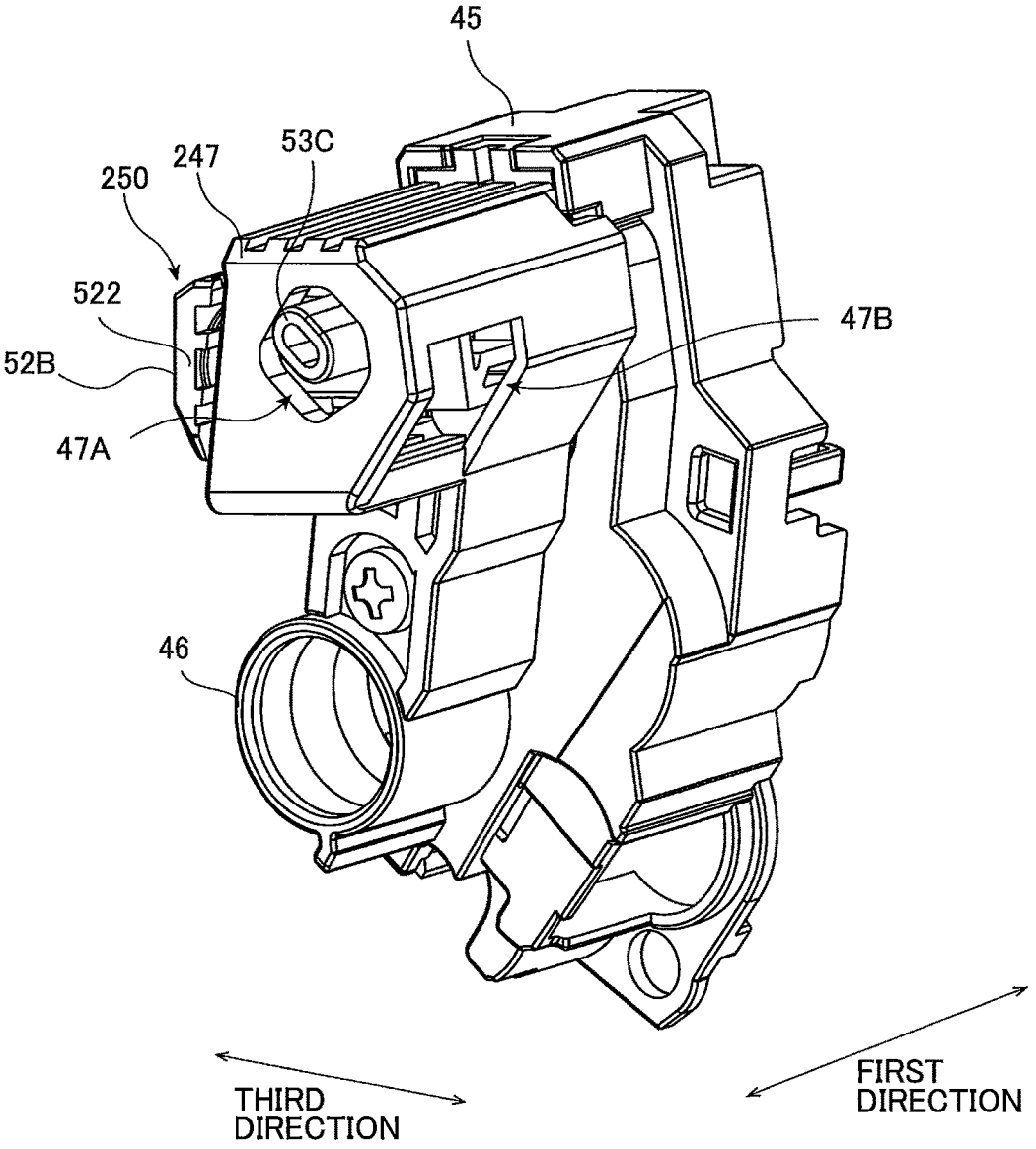
FIG. 18 is a perspective view of the developing cartridge according to the second embodiment as viewed from a side opposite to a second outer surface of a holder in the third direction.

FIG. 18 is a perspective view of the developing cartridge 1 as viewed in the third direction from the opposite side of the second outer surface 52B of the holder 252. In FIG. 18, the cover 45 and the holder cover 247 are illustrated.

A cutout 47B is formed in a surface of the holder cover 247 positioned at an opposite side of the second holder member 522 in the third direction. The cutout 47B corresponds to the recess 521B of the first embodiment. That is, in a state where the developing cartridge 1 is attached to the corresponding drum cartridge 2, the protrusion 73 (see FIG. 10) is fitted in the cutout 47B.

2-2. Insertion of the Developing Cartridge

The developing cartridges 1 attached to the respective drum cartridges 2 are inserted in the second direction into the respective slots 91 of the cartridge holder 90. Hereinafter, the position of the second holder member 522 illustrated in FIGS. 16 and 17 will be referred to as a "first position". The second holder member 522 is at the first position before each developing cartridge 1 is inserted into the corresponding slot 91. At this time, the coil spring 523 has a first length in the third direction that is the natural length of the coil spring 523. However, the first length may be increased or decreased from the natural length to such an extent that resilient force is not generated in the coil spring 523.

Figure 19:
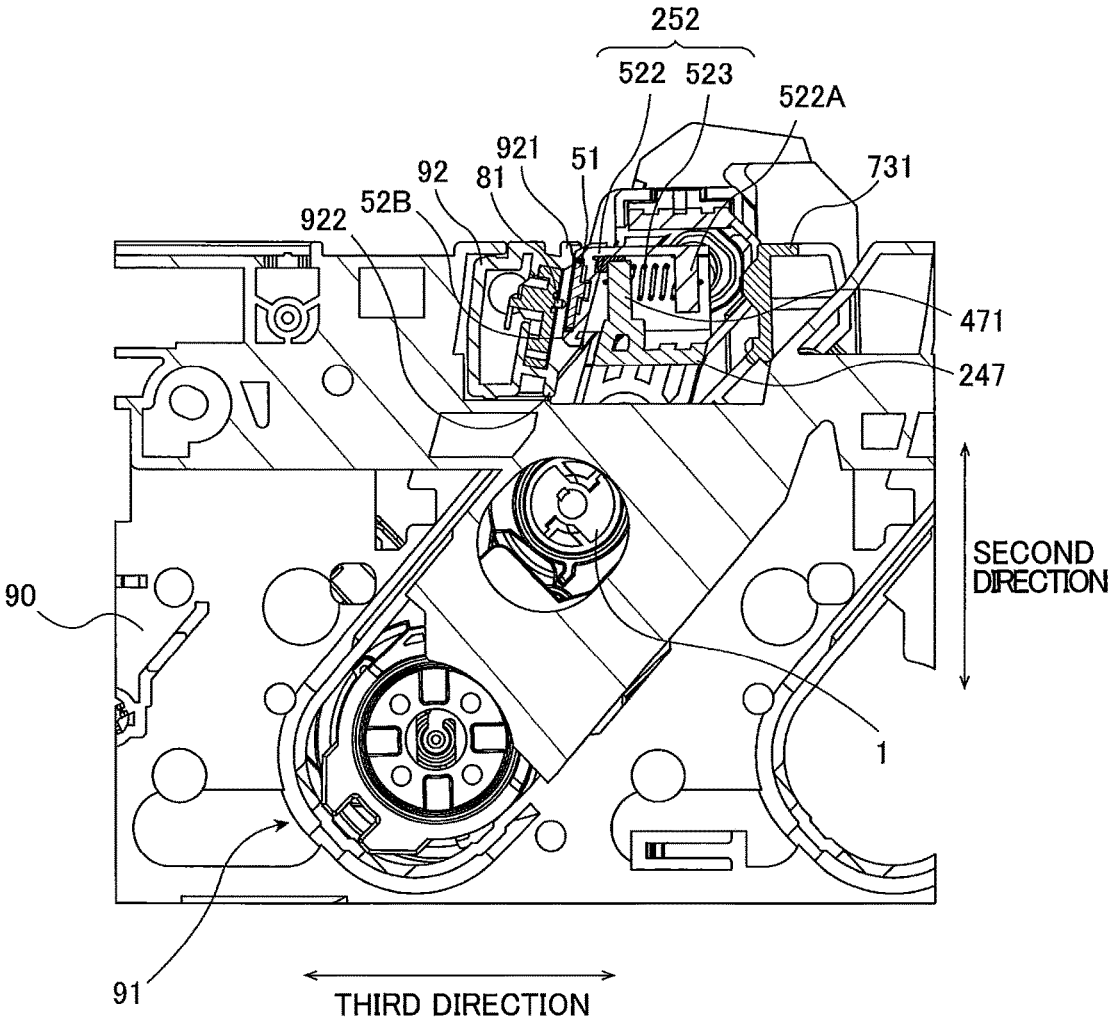
FIG. 19 is a view illustrating a state where the developing cartridge according to the second embodiment is in a process of being inserted into the image-forming apparatus.

FIG. 19 is a view illustrating a state where the developing cartridge 1 is being inserted relative to the image-forming apparatus 100.

When the developing cartridge 1 is inserted into the corresponding slot 91, the second outer surface 52B of the second holder member 522 contacts the first protruding portion 921. FIG. 19 illustrates a state where the developing cartridge 1 is further inserted into the slot 91 in the insertion direction after the second outer surface 52B contacts the first protruding portion 921.

As the developing cartridge 1 is inserted into the corresponding slot 91 further in the insertion direction, the developing cartridge 1 is guided by the frame (not shown) of the cartridge holder 90. The developing cartridge 1 thus moves in the third direction toward the guide portion 92 relative to the corresponding slot 91. At this time, the second outer surface 52B of the second holder member 522 is in contact with the first protruding portion 921. Thus, the second holder member 522 does not move toward the guide portion 92. On the other hand, the holder cover 247 moves in the third direction toward the guide portion 92. That is, the holder cover 247 approaches toward the second holder member 522.

As described above with reference to FIG. 17, the holder cover 247 includes the boss 471. That is, the boss 471 does not move in the third direction. The second holder member 522 includes the boss 522A. That is, the boss 522A moves in the third direction. The boss 471 is positioned closer to the guide portion 92 than the boss 522A is to the guide portion 92 in the third direction. Accordingly, as the holder cover 247 approaches the second holder member 522, the boss 471 moves in a direction away from the boss 522A. The coil spring 523 expands accordingly, since a distance between the boss 471 and the boss 522A is increased. The length of the coil spring 523 in the third direction at this time is a second length longer than the first length. The contraction force acting in the third direction is thus generated in the expanding coil spring 523. Due to this contraction force, the second holder member 522 is applied with pressing force acting in the third direction toward the guide portion 92. Hereinafter, the position of the second holder member 522 relative to the holder cover 247 in the third direction will be referred to as a "second position".

Figure 20:
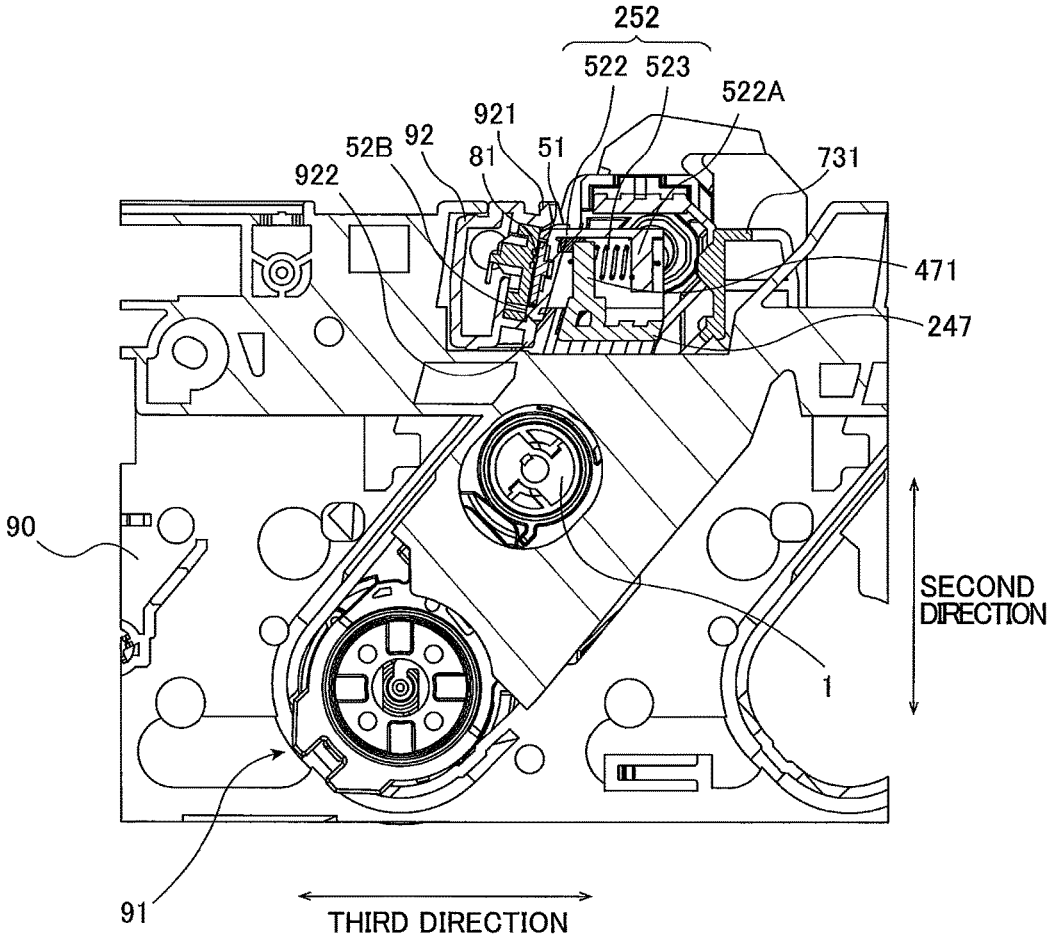
FIG. 20 is a view illustrating a state where insertion of the developing cartridge according to the second embodiment in the image-forming apparatus is completed.

FIG. 20 is a view illustrating a state where the insertion of the developing cartridge 1 relative to the image-forming apparatus 100 has been completed.

As the developing cartridge 1 is further inserted in the insertion direction from the state shown in FIG. 19, the second holder member 522 rides over the first protruding portion 921. Since the second holder member 522 is applied with the pressing force acting in the third direction toward the guide portion 92 by the contraction force of the coil spring 523, the second holder member 522, which has moved past the first protruding portion 921, moves in the third direction toward the guide portion 92. As a result, the electrical contact surfaces 511 of the IC chip 51 are brought into contact with the electrical connector 81.

Hereinafter, the position of the second holder member 522 relative to the holder cover 247 in the third direction in a state where the electrical contact surfaces 511 and the electrical connector 81 contact each other will be referred to as a "third position". When the second holder member 522 is at the third position, the coil spring 523 has a third length in the third direction that is shorter than the second length and longer than the first length. That is, when the second holder member 522 is at the third position, the contraction force continues to be generated in the coil spring 523. That is, the electrical contact surfaces 511 of the IC chip 51 are pressed against the electrical connector 81. Thus, the contact between the electrical contact surfaces 511 and the electrical connector 81 can be maintained reliably.

As described above, the second outer surface 52B contacts the first protruding portion 921, and rides over the first protruding portion 921 while changing the position thereof in the third direction. After the second outer surface 52B moves past the first protruding portion 921, the electrical contact surfaces 511 directly contact the electrical connector 81. Thus, once the contact is established, there is little change in the contact position of the electrical connector 81 relative to the electrical contact surfaces 511. This structure of the second embodiment can reduce a likelihood that the electrical contact surfaces 511 are rubbed.

In particular, the electrical contact surfaces 511 of the IC chip 51 are positioned in a recessed portion on the second outer surface 52B in the third position. Thus, the first protruding portion 921 does not contact the electrical contact surfaces 511 during the insertion of the developing cartridge 1. This structure can prevent the electrical contact surfaces 511 from being ribbed by the first protruding portion 921.

3. Variations and Modifications

While the description has been made in detail with reference to the embodiments thereof, it would be apparent to those skilled in the art that many modifications and variations may be made therein without departing from the scope of the disclosure.

While the coil spring 523 is exemplified as an example of a resilient member in the above embodiments, the resilient member of the present disclosure is not limited to the coil spring. For example, the resilient member may be a leaf spring, a torsion spring, rubber, or sponge, provided that the resilient member is a member having resiliency. Further, the configurations of the first holder member 521, the second holder member 522, or the holder cover 247 may be altered according to the type of the resilient member to be used. That is, the first holder member 521, second holder member 522, or holder cover 247 may be so configured to enable the electrical contact surfaces 511 to move in the third direction to press the electrical contact surfaces 511 against the electrical connector 81 using the contraction force of the resilient member.

In the above embodiments, the IC chip 51 including the electrical contact surfaces 511 is fixed to the second outer surface 52B of the holder 52, 252. However, only the electrical contact surfaces 511 configured to contact the electrical connector 81 may be fixed to an outer surface of the holder 52, 522, while a portion of the IC chip 51 other than the electrical contact surfaces 511 may be positioned on a different portion of the developing cartridge 1.

Further, in the above embodiments, the developing cartridge 1 is attached to the corresponding drum cartridge 2 and then mounted to the cartridge holder 90. However, the developing cartridge 1 may be attached to a cartridge holder to which a drum cartridge including the photosensitive drum is attached.

Further, the respective elements described in the above embodiments and modifications may be combined as appropriate as long as no contradiction is involved.

What is claimed is:

1. A developing cartridge comprising:

a housing configured to accommodate a developer therein;

a developing roller rotatable about a first axis extending in a first direction, the developing roller being positioned at one end of the housing in a second direction;

a storage medium including an electric contact surface;

a resilient member positioned at one end of the housing in the first direction, the resilient member being configured to expand and contract in a third direction crossing the electric contact surface;

a first holder positioned at the one end of the housing in the first direction, one end of the resilient member in the third direction being connected to the first holder;

a second holder holding the electric contact surface, another end of the resilient member in the third direction being connected to the second holder, the second holder being movable relative to the first holder in the third direction between a first position and a second position closer to the first holder than the first position is to the first holder, wherein, in a case where the second holder moves from the first position to the second position, the resilient member expands and pressing force acting in a direction from the second position toward the first position is generated by contraction force of the expanded resilient member, and wherein an entirety of the second holder is movable relative to the first holder in the third direction between the first position and the second position closer to the first holder than the first position is to the first holder.

2. The developing cartridge according to claim 1, wherein the second direction crosses the first direction.

3. The developing cartridge according to claim 1, wherein the first holder is a portion of the housing.

4. The developing cartridge according to claim 1, wherein the first holder is attached to the housing.

5. The developing cartridge according to claim 4, wherein the first holder is fixed to the housing.

6. The developing cartridge according to claim 1, wherein the first holder has one end portion in the third direction and another end portion away from the one end portion in the third direction;

wherein the second holder has one end portion in the third direction and another end portion away from the one end portion of the second holder in the third direction;

wherein the second holder holds the electric contact surface at the one end portion of the second holder in the third direction;

wherein the another end of the resilient member is connected to the another end portion of the second holder;

wherein the one end portion of the first holder is positioned between the one end portion of the second holder and the another end portion of the second holder;

wherein the another end portion of the second holder is positioned between the one end portion of the first holder and the another end portion of the first holder;

wherein the one end of the resilient member is connected to the one end portion of the first holder in the third direction; and wherein, in a case where the second holder moves from the first position to the second position and the another end portion of the second holder moves away from the one end portion of the first holder, the resilient member expands; the pressing force is generated by the contraction force of the expanded resilient member acting in a direction toward the one end portion of the first holder and the pressing force is applied to the another end portion of the second holder; and the second holder is moved from the second position to the first position by the pressing force.

7. The developing cartridge according to claim 6, the developing cartridge being configured to be mounted in a frame, wherein, in a case where the developing cartridge is mounted to the frame, the second holder moves in the third direction from the first position to the second position and from the second position to a third position;

wherein the resilient member has a first length at the first position of the second holder;

wherein the resilient member has a second length greater than the first length at the second position of the second holder;

wherein the resilient member has a third length smaller than the second length and greater than the first length at the third position of the second holder;

wherein the contraction force for contracting the second length into the first length is generated in the resilient member at the second length; and wherein the contraction force for contracting the third length into the first length is generated in the resilient member at the third length.

8. The developing cartridge according to claim 6, wherein the second holder holds the electric contact surface at an outer surface of the one end portion of the second holder.

9. The developing cartridge according to claim 1, wherein the second holder is movable in the second direction relative to the housing.

10. The developing cartridge according to claim 9, further comprising a holder cover positioned at one end of the housing in the first direction, the holder cover covering at least a portion of the first holder and the second holder, the holder cover having one of a first recess and a first through-hole, wherein the second holder has a first boss extending in the first direction and the first boss is inserted into the one of the first recess and the first through-hole, and wherein the first recess and the first through-hole have a dimension in the second direction greater than a dimension of the first boss in the second direction.

11. The developing cartridge according to claim 10, further comprising:

a gear positioned at the one end of the housing in the first direction, the gear being rotatable about a second axis extending in the first direction; and a gear cover positioned at the one end of the housing in the first direction, the gear cover covering at least a portion of the gear, the gear cover having one of a second recess and a second through-hole, wherein the second holder has a second boss extending in the first direction and the second boss is inserted into one of the second recess and the second through-hole, and wherein the second recess and the second through-hole have a dimension in the second direction greater than a dimension of the second boss in the second direction.

12. The developing cartridge according to claim 1, wherein the resilient member is a spring.

13. The developing cartridge according to claim 1, wherein the resilient member is a coil spring.

14. The developing cartridge according to claim 1, wherein the second holder has an outer surface in the third direction, the second holder holding the electric contact surface at the outer surface.

15. The developing cartridge according to claim 1, wherein the storage medium having the electric contact surface is held to the second holder.

16. The developing cartridge according to claim 1, wherein the developing cartridge is configured to be mounted to a frame, the frame including:

a guide portion configured to press the second holder in the third direction from the first position toward the second position; and an electric contact configured to contact the electric contact surface, and wherein the second holder is pressed in the third direction from the first position toward the second position by the guide portion, and is then moved from the second position toward the first position by the pressing force generated by the contraction force of the resilient member to allow the electric contact surface to contact the electric contact after the second holder is moved past the guide portion.

* * * * *